US011085182B2

(12) United States Patent
Rosan

(10) Patent No.: US 11,085,182 B2
(45) Date of Patent: Aug. 10, 2021

(54) MODULAR WALL PANELS AND SYSTEM

(71) Applicant: Versare Solutions, LLC, Minneapolis, MN (US)

(72) Inventor: Arnon Rosan, New York, NY (US)

(73) Assignee: Versare Solutions, LLC, Minneapolis, MN (US)

( * ) Notice: Subject to any disclaimer, the term of this patent is extended or adjusted under 35 U.S.C. 154(b) by 0 days.

(21) Appl. No.: 16/573,258

(22) Filed: Sep. 17, 2019

(65) Prior Publication Data

US 2020/0217067 A1 Jul. 9, 2020

Related U.S. Application Data

(63) Continuation-in-part of application No. 16/242,742, filed on Jan. 8, 2019.

(51) Int. Cl.

| | |
|---|---|
| ***E04B 2/42*** | (2006.01) |
| ***E04B 2/74*** | (2006.01) |
| ***E04B 2/72*** | (2006.01) |

(52) U.S. Cl.

CPC ..... *E04B 2/721* (2013.01); *E04B 2/7425* (2013.01); *E04B 2002/742* (2013.01)

(58) Field of Classification Search

CPC ..... E04B 1/34321; E04B 2002/7461; E04C 1/24; E04C 2/08; E04C 2/14; E04C 2/18;

(Continued)

(56) References Cited

U.S. PATENT DOCUMENTS 1,344,803 A * 6/1920 Lannert ..... E04B 2/14 52/289
1,400,709 A * 12/1921 Worthington ..... E04C 1/39 52/372

(Continued)

FOREIGN PATENT DOCUMENTS

WO 8703321 6/1987

OTHER PUBLICATIONS

United States Patent and Trademark Office; Office Action; Office Action from U.S. Appl. No. 16/242,742; pp. 1-20; publisher United States Patent and Trademark Office; published Alexandria, Virginia, USA; copyright and dated Feb. 4, 2020; copy enclosed (20 pages).

(Continued)

*Primary Examiner* — Brian E Glessner
*Assistant Examiner* — James J Buckle, Jr.
(74) *Attorney, Agent, or Firm* — Metz Lewis Brodman Must O'Keefe LLC

(57) ABSTRACT

Modular wall panels having a frame of a plurality of frame components and at least one wall sheet affixed to the frame. Frame component may have angled ends, straight ends, or a combination thereof. Each end of the frame components may have at least one fastener or at least one corresponding receiver to selectively connect adjacent frame components end on end in forming a frame, including corners. Frames can thus be assembled in the field and are fully customizable. A hub may be utilized with multiple sides having fastener(s) or receiver(s) to interconnect frame components. A wall system includes a plurality of such wall panels connected to one another along the outer surfaces of the frame components of their respective frames.

34 Claims, 23 Drawing Sheets

(58) Field of Classification Search
CPC .... E04C 2/22; E04C 2/30; E04C 2/205; E04F 15/02417; E04F 15/02452; E04F 15/02458; E04F 2201/0107; E04F 2201/0115
USPC ..... 52/204.1
See application file for complete search history.

(56) References Cited

U.S. PATENT DOCUMENTS 1,550,606 A * 8/1925 Dale et al. ..... E04B 5/21 52/577
2,153,913 A * 4/1939 Blackwell ..... E04B 2/28 52/430
2,392,552 A * 1/1946 Roe ..... E04B 2/14 52/309.1
3,292,331 A 12/1966 Sams
3,305,982 A * 2/1967 Steele ..... E04B 2/18 52/90.1
3,327,440 A 6/1967 Watkins
3,382,632 A * 5/1968 Grofcsik ..... E04B 2/10 52/223.7
4,118,903 A 10/1978 Coulthard
4,191,001 A * 3/1980 L'Heureux ..... E04F 13/02 52/741.41
4,249,336 A * 2/1981 Moe ..... A63H 3/04 248/448
4,262,463 A * 4/1981 Hapel ..... E04B 2/18 52/98
4,547,331 A 10/1985 Batstra
4,949,519 A 8/1990 Jeffers
4,996,811 A 3/1991 Dull
5,163,259 A * 11/1992 Hunsaker ..... E04B 2/704 52/233
5,187,908 A * 2/1993 Losensky ..... E04B 2/7425 160/135
5,285,607 A * 2/1994 Somerville ..... E04B 1/762 52/235
5,292,189 A * 3/1994 Lau ..... H05K 7/183 312/265.3
5,339,798 A * 8/1994 Christian ..... E04B 2/708 126/629
5,519,971 A * 5/1996 Ramirez ..... E04C 2/288 52/220.2
5,720,138 A * 2/1998 Johnson ..... E04B 2/767 52/220.7
5,724,782 A * 3/1998 Rice ..... E04B 2/8629 52/745.05
5,826,394 A * 10/1998 Barton, Jr. ..... A63H 33/044 52/592.1
5,826,395 A * 10/1998 Weaver ..... E04B 2/14 52/606
D403,028 S * 12/1998 Barton, Jr. ..... D21/486
5,842,276 A 12/1998 Asher
D410,704 S * 6/1999 Krog ..... D21/486
5,921,046 A 7/1999 Hammond et al.
5,921,047 A 7/1999 Walker
6,088,987 A 7/2000 Simmons
6,105,330 A * 8/2000 Nanayakkara ..... E04B 2/14 52/590.2
6,115,977 A * 9/2000 Hornberger ..... A47B 95/008 52/238.1
6,138,426 A * 10/2000 Mork ..... E04B 1/703 52/293.2
6,167,665 B1 * 1/2001 Dame ..... E04B 2/7425 52/239
6,202,381 B1 * 3/2001 Dame ..... E04B 2/7425 52/239
6,209,273 B1 4/2001 Jeffers et al.
6,223,485 B1 * 5/2001 Beck ..... E04B 2/7425 52/239
6,336,298 B1 * 1/2002 Chou ..... E04B 2/7457 52/238.1
6,550,208 B2 * 4/2003 Nanayakkara ..... E04B 2/14 52/223.7
6,571,525 B2 6/2003 Coleman
6,609,336 B2 * 8/2003 Matsubara ..... E04B 1/02 446/115
6,729,085 B2 * 5/2004 Newhouse ..... B25B 5/003 52/239
6,983,569 B1 * 1/2006 Rosenberg ..... E04B 2/7457 52/241
7,127,856 B2 10/2006 Hagen et al.
7,168,216 B2 1/2007 Hagen et al.
7,185,460 B2 3/2007 Corden
7,562,500 B2 * 7/2009 Siu ..... E04B 1/24 52/236.3
7,603,821 B2 * 10/2009 Eberlein ..... E04B 2/7425 52/238.1
7,850,390 B2 * 12/2010 Lisbona ..... B01D 46/0004 220/668
8,046,962 B2 10/2011 Glick
D686,676 S * 7/2013 Telford ..... D21/486
8,695,304 B2 * 4/2014 Robinson ..... E04B 2/04 52/596
8,800,230 B2 8/2014 O'Connor
8,887,459 B2 * 11/2014 Wheeler ..... E04B 2/7457 52/238.1
9,032,682 B2 5/2015 Knoll
9,187,895 B2 11/2015 Rodriguez Carassus
D783,731 S 4/2017 Rosan
D786,586 S 5/2017 Rosan
D791,885 S 7/2017 Rosan
D800,846 S 10/2017 Rosan
D809,162 S 1/2018 Rosan
10,010,805 B2 * 7/2018 Maxam ..... E04B 2/7405
10,167,632 B2 * 1/2019 Maxam ..... A63J 1/02
10,196,826 B1 * 2/2019 Rosan ..... E04F 15/02452
D862,202 S * 10/2019 Niu ..... D8/354
10,683,661 B2 6/2020 Bigelow
2004/0211127 A1 * 10/2004 Wiechecki ..... E04B 2/7427 52/36.1
2006/0137277 A1 * 6/2006 Katwyk ..... E04B 1/08 52/481.1
2008/0222979 A1 * 9/2008 Rissmiller ..... E06B 1/60 52/213
2009/0049788 A1 * 2/2009 Thorpe ..... E04B 2/14 52/605
2009/0113836 A1 5/2009 Pitchers
2009/0173027 A1 * 7/2009 Bennett ..... E04C 1/40 52/309.17
2009/0188188 A1 7/2009 Rivet
2010/0186326 A1 * 7/2010 Cummings ..... E04B 2/7422 52/239
2010/0270299 A1 * 10/2010 Baltussen ..... H01J 37/16 220/4.33
2010/0325989 A1 * 12/2010 Leahy ..... E04B 1/14 52/270
2011/0099929 A1 * 5/2011 Liegeois ..... E04B 2/7425 52/241
2011/0146180 A1 * 6/2011 Klein ..... E04B 2/7409 52/317
2011/0225909 A1 * 9/2011 Rodriguez Carassus ..... E04B 2/44 52/261
2013/0019541 A1 1/2013 Lin
2014/0033631 A1 * 2/2014 Rokk ..... E04B 1/34321 52/582.2
2014/0053481 A1 * 2/2014 Leahy ..... E04B 1/34321 52/270
2014/0090325 A1 * 4/2014 Maeers ..... E04B 2/18 52/503
2015/0143763 A1 * 5/2015 Gosling ..... E04B 2/7448 52/220.7
2015/0197935 A1 * 7/2015 Gosling ..... E04B 2/745 52/205
2016/0017653 A1 * 1/2016 Bottin ..... E04B 1/3483 52/79.1
2016/0237707 A1 * 8/2016 Maxam ..... A63J 1/02

(56) References Cited

U.S. PATENT DOCUMENTS

| | | | | |
|---|---|---|---|---|
| 2017/0306610 | A1* | 10/2017 | Leahy | E04B 1/34321 |
| 2018/0300433 | A1 | 10/2018 | Maxam et al. | |
| 2019/0010691 | A1* | 1/2019 | Moran | E04B 1/3483 |

OTHER PUBLICATIONS

International Searching Authority; International Search Report and Written Opinion of the International Searching Authority; International Application No. PCT/US2019/068555; Patent Cooperation Treaty; pp. 1-13; publisher United States International Searching Authority; Published Alexandria, Virginia, US; copyright and dated Feb. 28, 2020; copy enclosed (13 pages).

Best-Rite Fabric Standard Modular Panel, 6'x5', Gray; Staples website, Dec. 7, 2018 (7 pages); https://www.staples.com/Best-Rite-Fabric-Standard-Modular-Panel-6x5-Gary/product_302619.

United States Patent and Trademark Office; Office Action; Office Action regarding U.S. Appl. No. 16/242,742; pp. 1-29 publisher United States Patent and Trademark Office; published Alexandria, Virginia, USA; copyright and dated Aug. 20, 2020; copy enclosed (29 pages).

International Searching Authority; International Search Report and Written Opinion of the International Searching Authority; International Application No. PCT/US20/50991; Patent Cooperation Treaty; pp. 1-9; publisher United States International Searching Authority; Published Alexandria, Virginia, US; copyright and dated Oct. 21, 2020; copy enclosed (9 pages).

* cited by examiner

MODULAR WALL PANELS AND SYSTEM

CROSS-REFERENCE TO RELATED APPLICATIONS

The present application is a Continuation-in-Part of U.S. patent application Ser. No. 16/242,742 filed on Jan. 8, 2019, currently pending, the contents of which are hereby incorporated by reference in its entirety.

FIELD OF THE INVENTION

This invention relates to wall systems, and more particularly, to modular wall systems formed of various wall panels and interlocking frame components for a customizable wall system.

BACKGROUND

Temporary walls are needed in many settings, such as for events like exhibitions, trade shows, and festivals. Such temporary walls need to be easy to assemble and disassemble and also easy to transport. Current modular wall offerings are made of sheetrock or plywood and are therefore quite heavy and cumbersome to transport, often requiring multiple people or trips to transport to a site. This makes them difficult to use if there is only one person transporting and setting up the walls, or if there are many other items being transported as well, such as merchandise or supplies. Existing modular walls often require affixing one to another with hinges or connection hardware that requires tools to assemble or connect and disconnect. A person must therefore also transport tools for assembly, adding to the weight and bulk of materials being transported. Their cumbersome nature also makes existing wall panels difficult to alter once installed, such as updating, repositioning, and changing configurations. They are difficult to use and are limited in their functionality and customization. For instance, they may only attach a certain number of ways and do not stack on one another for height variation or extension.

What is needed therefore is a wall system that can be quickly and easily assembled and disassembled for ease of use. Lighter weight walls would also be beneficial to make transportation easier, but they still need to be structurally sound. These two aspects are at odds with one another. A fully customizable temporary wall system is still lacking in the art, and one which can be customized not only to size and configuration but aesthetically as well to a variety of different palates.

SUMMARY

A modular wall system and panels are disclosed which address the above needs. Specifically, the modular wall system and wall panels of the present invention are lightweight, being made of lightweight material and having a substantially hollow interior to provide even lighter construction. The construction is structurally sound despite this light weight, each wall panel including a frame made of a plurality of frame components collectively supporting the wall panel from within. Wall sheets are mounted to the frame on at least one side, but preferably both sides to sandwich the frame between wall sheets made of lightweight material. The frame components making up the frame themselves are substantially hollow, having a plurality of apertures extending therethrough to allow access to the interior of the wall panel. However, the frame components may also include support ribs in the walls and may include at least one divider to separate the interior space of the frame component and provide additional structural support. Further support is provided by inserting cap(s) and/or connector(s) into the apertures of the frame components. Still further support may be provided by interlocking fasteners and receivers on the ends of some embodiments of frame components that allow the frame components to be selectively connected to one another to build a frame as desired. Such interlocking frame components provide a sturdy frame that resists bending, twisting, and coming apart, which therefore also makes the resulting wall panels more structurally sound. The fasteners and receivers are correspondingly configured to releasably engage one another, such as by snap-fit, frictional fit or otherwise, such that no tools are necessary to connect such frame components together and build a frame in the field to any specification.

Because the frame components forming the frame of each wall panel include a plurality of apertures, each wall panel may be connected to any other wall panel through the apertures in their outer edges. For example, at least one bi-directional connector may be received in an aperture of one wall panel and an aperture of an adjacent wall panel. Any number of connectors may be used with the apertures in the frame components to connect adjacent wall panels. Planar connectors may also be used to bridge between adjacent wall panels, inserting into the apertures of adjacent wall panels while spanning over the outer surface of the panels. Caps may be inserted into unused apertures to conceal the openings for aesthetics.

The wall panels may come in any size, shape and dimension for increased customization to fit any size space and desired configuration. The wall panels may also include a feature, such as a window, door or other structure within the boundaries of the panel, such as to provide for designs, logos, indicia, backlighting, and other design features as may be desired. The lightweight yet structurally sound design of the wall panels allows them to be combined in any number of ways, including stacked vertically on one another and intersecting at 90° angles to form joining walls. No tools are necessary, as the caps and connectors are simply inserted to assemble and may be removed by pulling to release.

Because of these features, the modular wall panels and system as described herein provides numerous options for different aesthetics, easier and faster assembly and disassembly without the need for tools, and the ability to run cables through the interior of the wall panels and system for power, connectivity, lighting, Internet and the like without having to sacrifice aesthetics. They may be used for any type of wall where customization or temporary walls may be used, such as but not limited to office walls, cubicles, wall dividers, apartments, trade shows, art exhibits, fairs, festivals and events.

The modular wall panels and system, together with their particular features and advantages, will become more apparent from the following detailed description and with reference to the appended drawings.

DESCRIPTION OF THE DRAWINGS

Like reference numerals refer to like parts throughout the several views of the drawings.

DETAILED DESCRIPTION

As shown in the accompanying drawings, the present invention is directed to modular wall panels and a wall system made thereof. The present modular wall panels and system are extremely lightweight. They provide minimal material and lightweight materials to increase mobility in the field for ease of transportation and use. The modular wall panels may be connected in any number of configurations as described in greater detail below to achieve a fully customizable system that a user can assemble to their own specifications. For example, the modular wall panels and system described herein may be used in a variety of settings, such as but not limited to office walls, cubicles, wall dividers, apartments, trade shows, art exhibits, fairs, festivals and events. The modular wall panels are also capable of having cables run through their interior, such as power cables for various lighting and devices, Internet, and other cables or wires as may be necessary for electronic connectivity and yet remain concealed for aesthetic purposes. The modular wall panels make for easy and customizable assembly, as well as quick disassembly, changing or updating as needs or desires dictate.

The modular wall panels described herein may be interoperable and used with any of the blocks, interfacing members, and floor panels as shown and described in U.S. Pat. Nos. D791,885, D809,162, D786,586, D783,731 and D800,846, and U.S. patent application Ser. Nos. 29/640,623 and 15/954,391, all of which are incorporated by reference herein.

Figure 1:
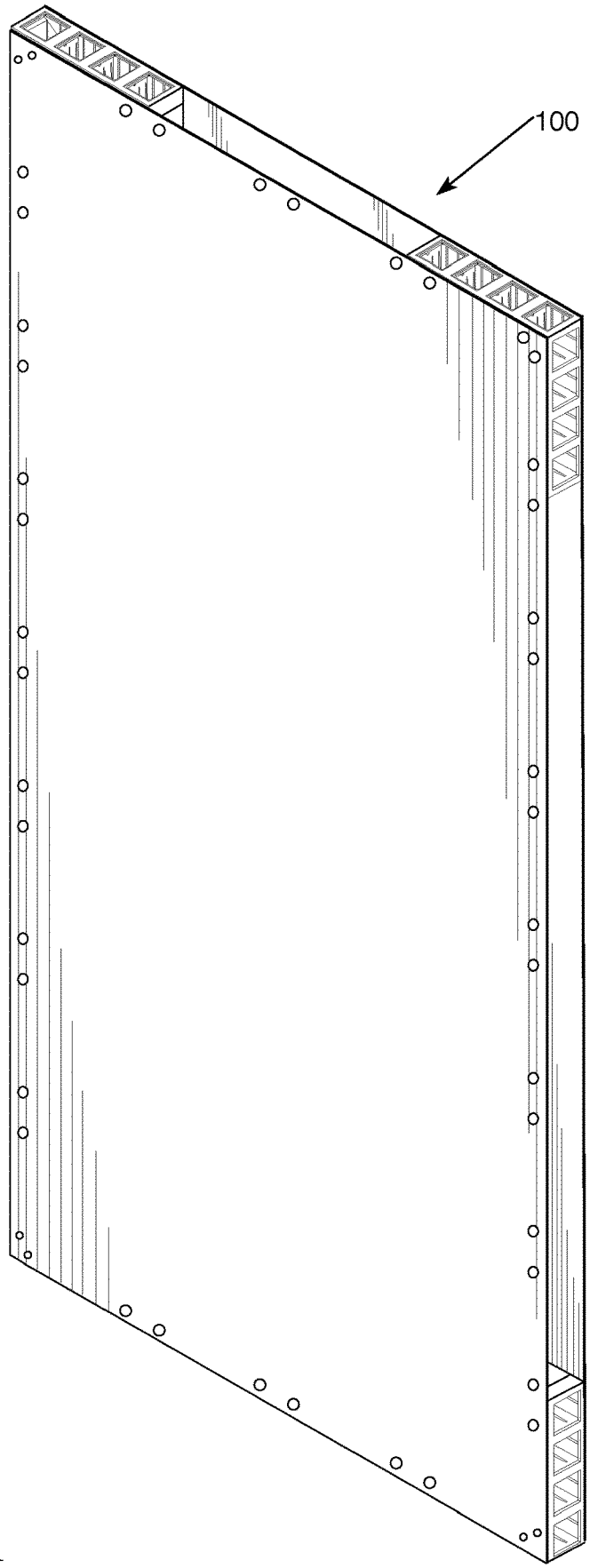
FIG. 1 is an perspective view of one exemplary embodiment of a modular wall panel of the present invention.
Figure 2:
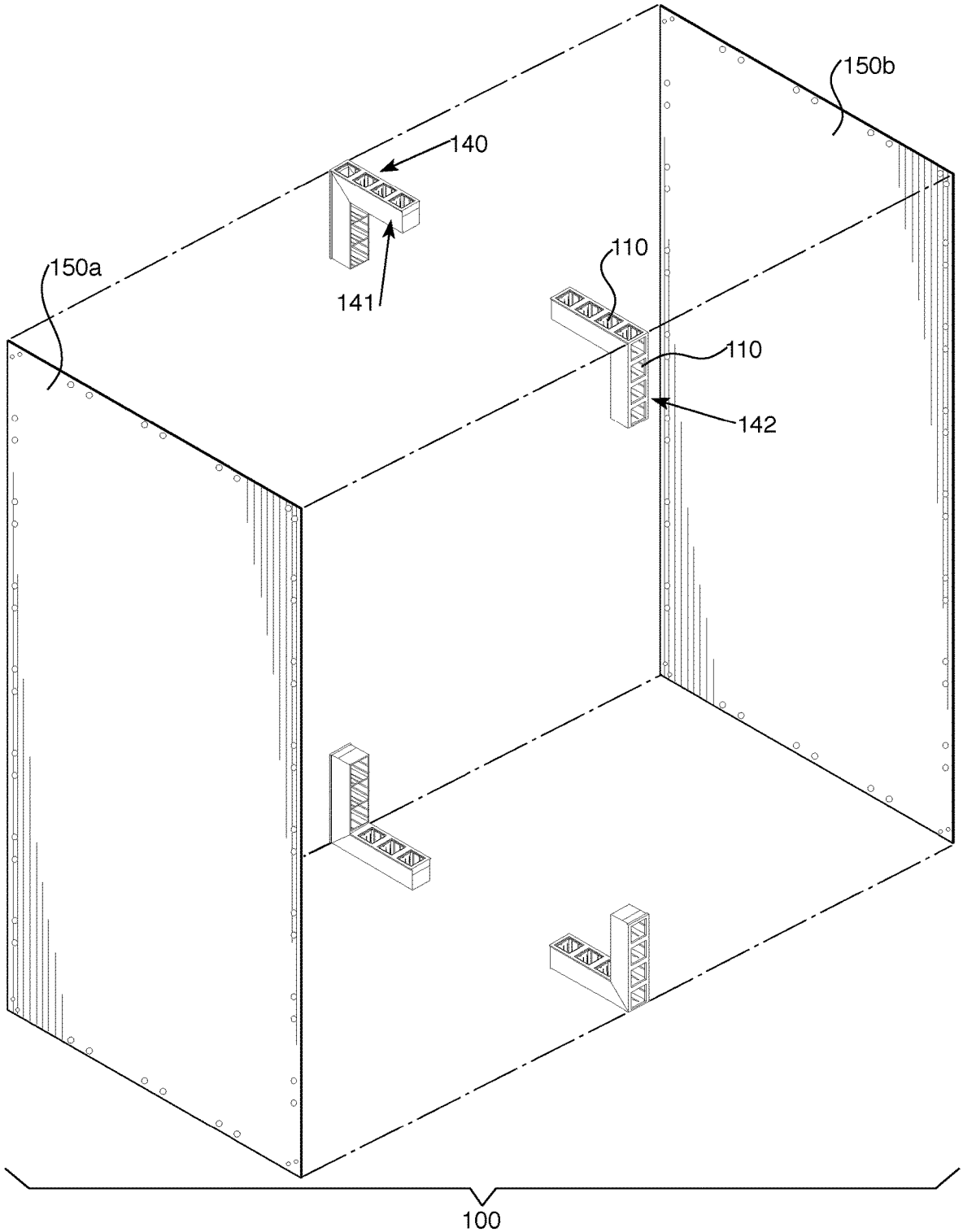
FIG. 2 is an exploded view of the modular wall panel of FIG. 1.

With reference now the Figures, the present invention is directed to modular wall panels 100 that may be connected to one another to form a modular and customizable wall system 200. As shown in FIGS. 1-2, each modular wall panel 100 is composed of at least one wall sheet 150 secured to a frame 140 made up of a plurality of frame components 110. The wall sheet 150 may be made of any lightweight material and may be flexible or rigid. For example, the wall sheet 150 may be made of materials such as but not limited to paper, fabric, wood, vinyl, fiberboard, fiberglass, fiberglass reinforced panel (FRP), styrofoam, polyvinyl chloride (PVC), expanded PVC, foam, polystyrene, polyurethane, polypropylene, acrylic, cardboard, carbon fiber, balsa, plastic, polymeric material, titanium, steel, stainless steel, magnesium, aluminum, zinc, carbon steel and metal alloys. In at least one embodiment, the wall panels 150 may be made of FRP which provides not only structural integrity in a lightweight material but is also fire retardant. In such embodiments, the wall panels 100 can be assembled into a wall system 200 that can act as a fire wall, such as may be useful in basements and garages where firewalls may be a desired safety precaution or mandated by building codes. The present wall system 200 can therefore be used to create a firewall to supplement existing walls without having to tear down and rebuild walls to code.

Figure 20:
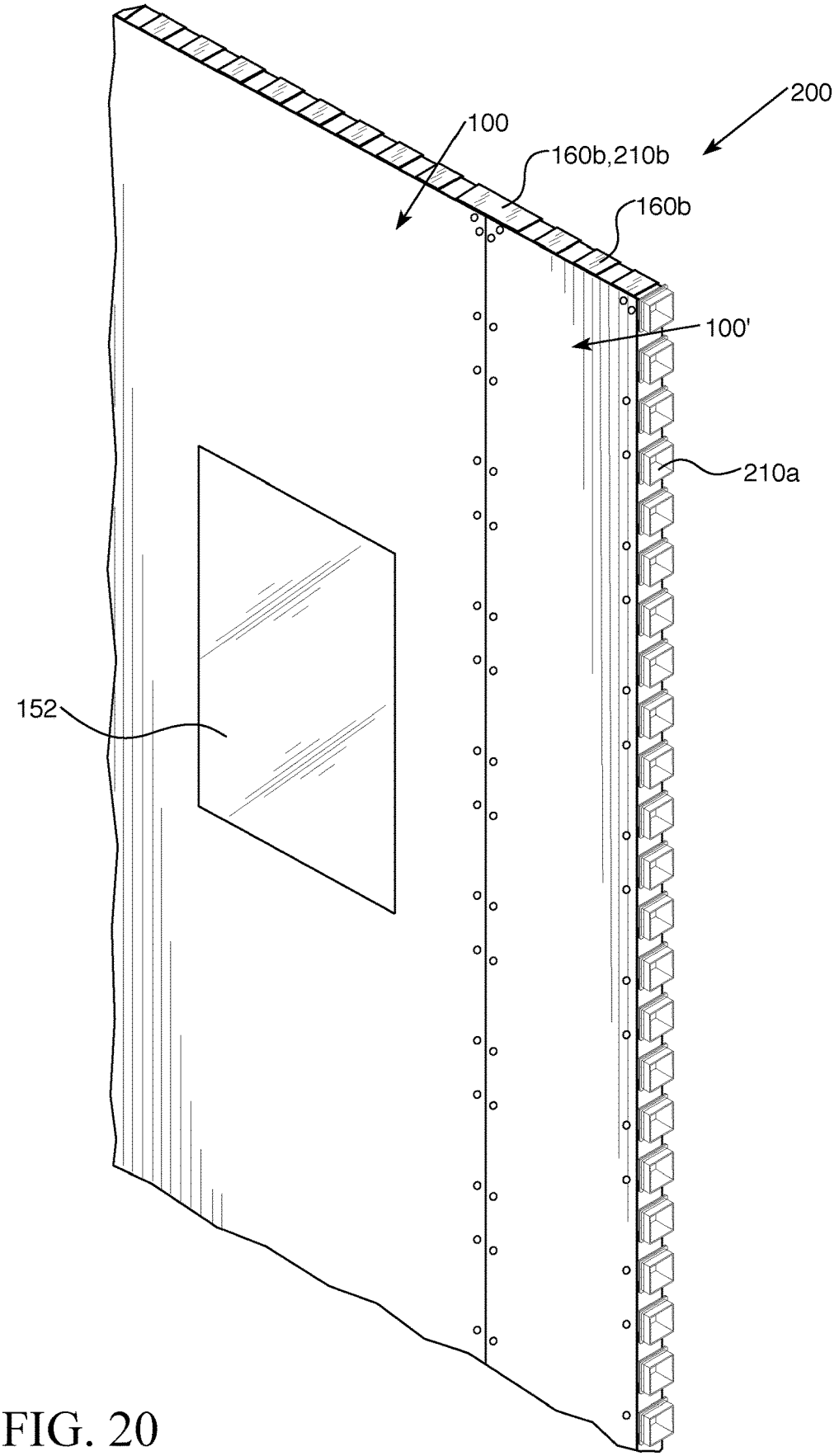
FIG. 20 is a partial perspective view of one embodiment of the modular wall system of the present invention.

The material comprising the wall sheets 150 may be of any color, design, or combination thereof. For instance, the wall sheets 150 may be a solid color or may be a combination of colors in a pattern or design. Artwork, logos, branding indicia, and other markings may also be present on the wall sheets 150. In some embodiments, the wall sheet 150 may include a feature 152, such as depicted in FIG. 20. The feature 152 may be a window, door, mesh screen or other similar structure interrupting or differing from the surface of the wall sheet 150. The feature 152 may be transparent, translucent or opaque. For instance, a transparent feature 152 such as a window may be useful in revealing items behind it (i.e., within the wall panel 100) such as lighting. Accordingly, in at least one embodiment, the feature 152 may be backlit with colored or white lights, such as LEDs, to create a lighting effect, ambiance or desired aesthetic. The feature 152 may be translucent or opaque so as to set off design elements, such as but not limited to logos for advertising or custom designs. The feature 152 may be made of the same or different material as the wall sheet 150, such as acrylic, vinyl or other material. In other embodiments, the feature 152 may be an optical or display screen, such as an LCD, LED or other similar screen suitable for displaying moving images thereon, and which may be touch-enabled for interactive display. The display screen feature 152 may be in electrical communication with a processor and/or computing device configured to receive, process and display visual information on the screen. It may also be in electrical communication with speakers to provide audio information as well, which may be presented simultaneously with the video. It may further be in electrical communication with the Internet, cloud, and/or a network such as available through WiFi, Bluetooth or direct communication.

Figure 3:
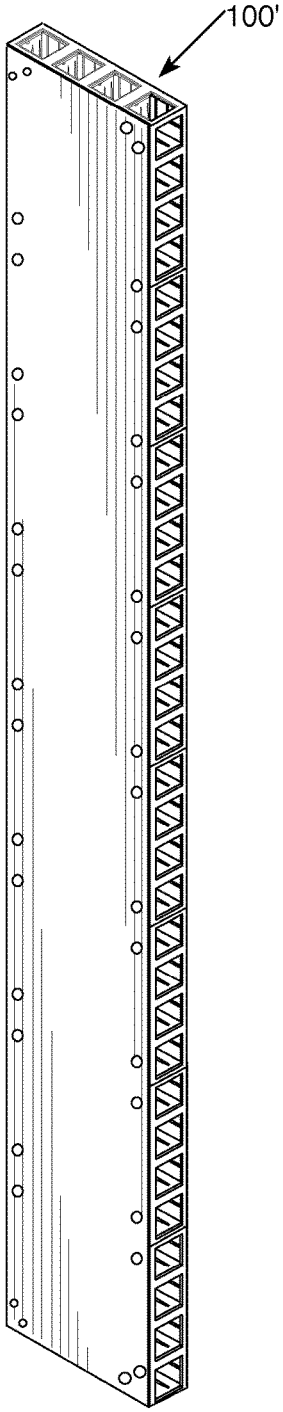
FIG. 3 is an perspective view of a second exemplary embodiment of a modular wall panel of the present invention.
Figure 4:
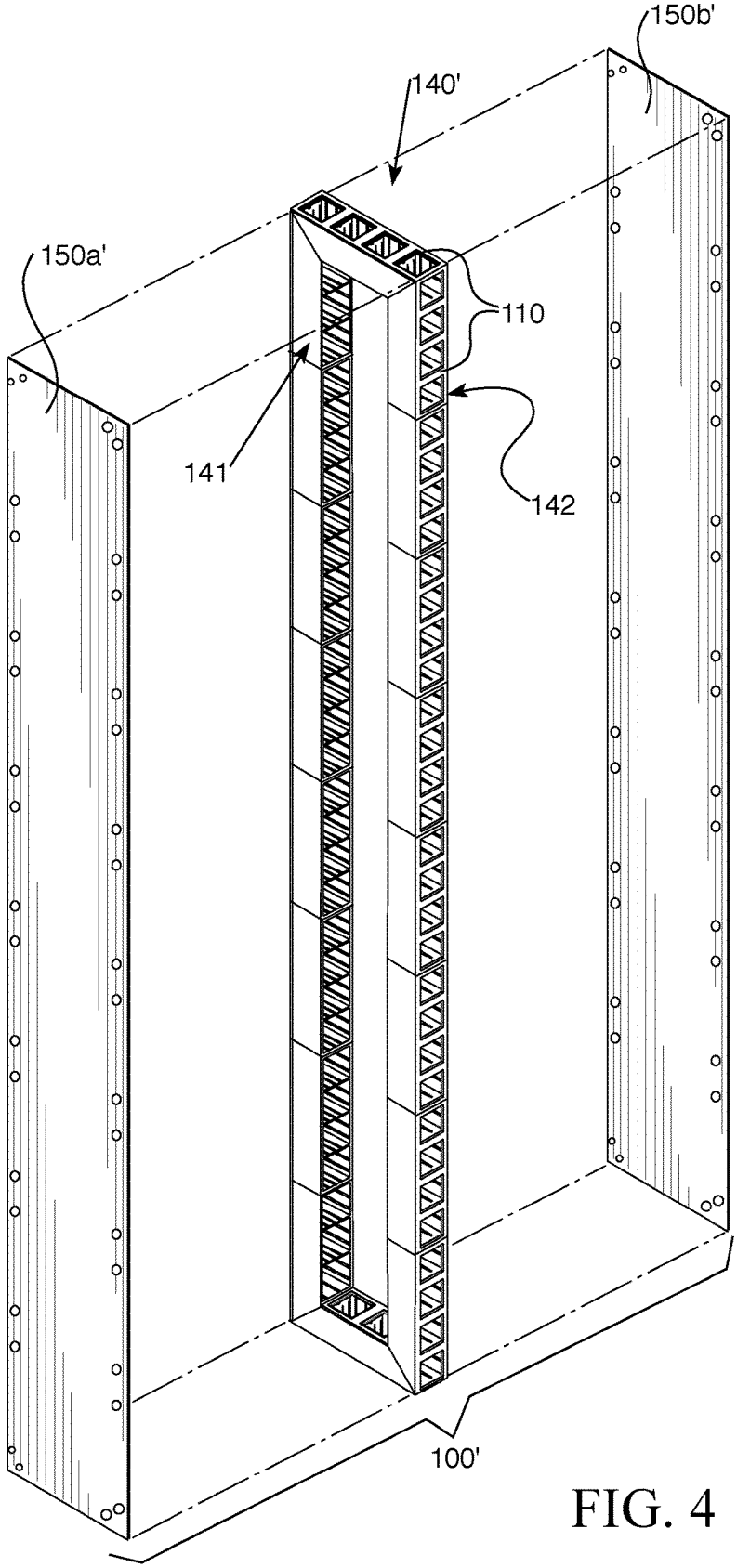
FIG. 4 is an exploded view of the modular wall panel of FIG. 3.

The wall panels 100 may be of any shape, such as but not limited to square and rectangular. They may also be any size and dimension. The particular shape, size and dimension of each wall panel 100 may be based, at least in part, on the geometry and/or size of the frame 140 which supports it. For example, a modular wall panel 100 may have a generally rectangular configuration and may be about 4 ft by 8 ft, as in FIGS. 1 and 2, or may be about 1 ft by 8 ft as in FIGS. 3 and 4. These are non-limiting examples for illustrative purposes only. The dimensions of the modular wall panels 100 may vary in increments of 1 foot, 6 inches, or other suitable increment as permitted by the shape and size of the frame components 110.

In forming the wall panel 100, wall sheets 150 are affixed to a face of the frame 140. For instance, as seen in FIGS. 1 and 2, a first wall sheet 150*a* is affixed to a first face 141 of a frame 140, and a second wall sheet 150*b* is affixed to a second face 142 of the frame 140. Similarly, in FIGS. 3 and 4, a narrower first wall sheet 150*a*' is affixed to a first face 141 of a frame 140', and a second wall sheet 150*b*' is affixed to a second face 142 of the frame 140' to form a narrower wall panel 100'. The wall sheets 150*a*, 150*b* may be affixed to the face of the frame 140 by any means, such as but not limited to by rivets, screws, bolts, adhesive, welding, hook and loop fasteners, and combinations thereof. Accordingly, the wall sheets 150*a*, 150*b* may be affixed to the face of the frame 140 by permanent or selective fastening. In at least one embodiment, the wall sheets 150*a*, 150*b* are permanently affixed to the frame 140 such as at a manufacturer's facility and are provided to end users as pre-assembled wall panels 100. In other embodiments, the frame 140 and wall sheets 150*a*, 150*b* may be provided separately to the end user and the end user may assemble the wall panel 100 to their own liking in the field, which may be changed later if desired.

Figure 21:
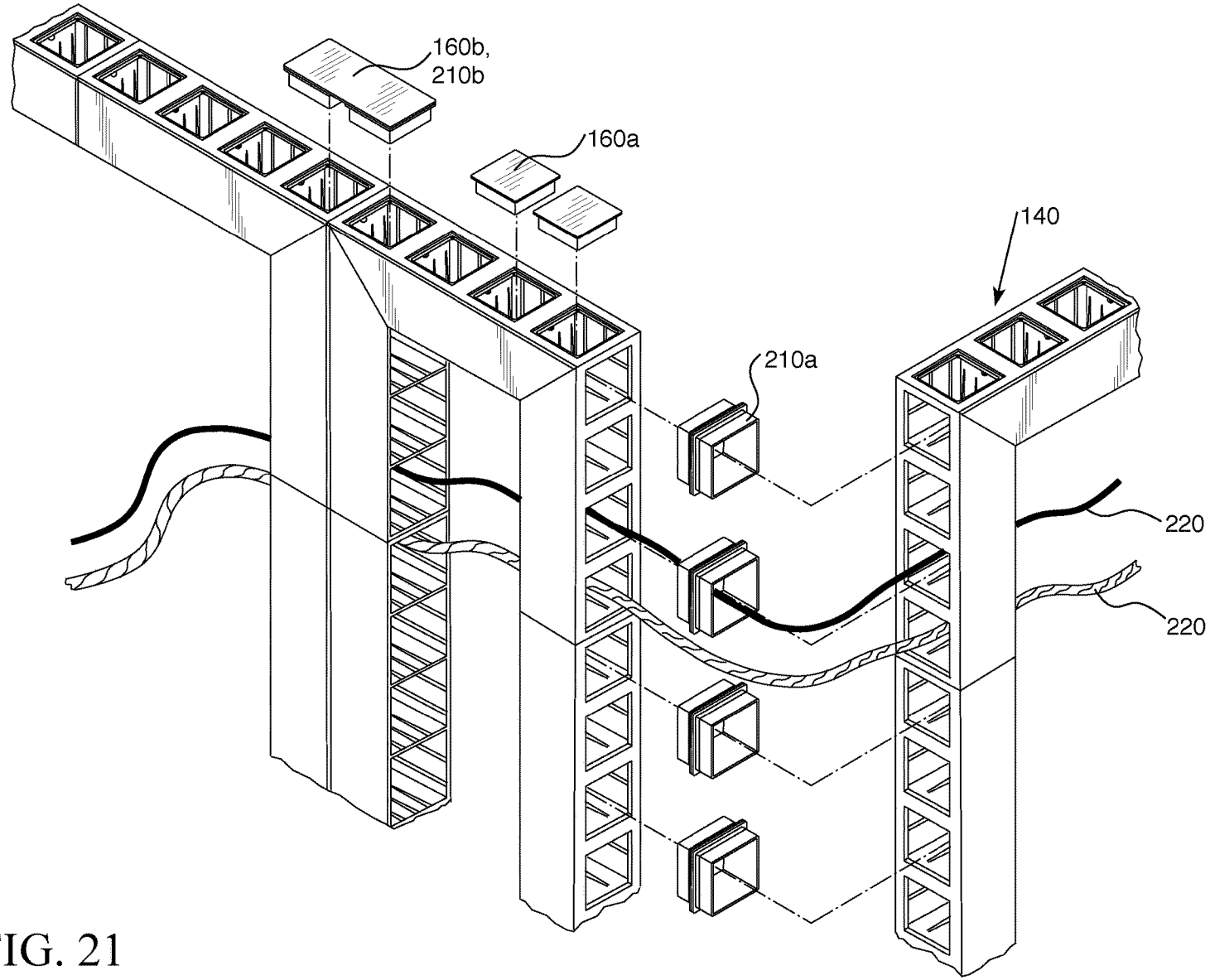
FIG. 21 is a partially exploded view of a portion of a modular wall system demonstrating connection of adjacent walls.

Different types of wall sheets 150*a*, 150*b*, such as of different materials or different configurations, may be affixed to the different faces 141, 142 of the frame 140. In other embodiments, the wall sheets 150*a*, 150*b* on either side of the frame 140 may be of the same type. In some embodiments, multiple wall sheets 150 may be affixed to the same face 141, 142 of the frame 140, such as when combining multiple smaller wall sheets 150 to fill a frame 140. Multiple wall sheets 150 of a size smaller than the frame 140 to which they are affixed may be used to provide different colors, designs, or create patterns across the entire wall panel 100 when assembled. When the wall sheets 150*a*, 150*b* are affixed to both sides of the frame 140, the resulting wall panel 100 is hollow inside. This hollow interior may be filled with foam or insulating material to convey insulating properties to the wall panel 100. The hollow interior of the wall panel 100 is also adapted for receiving and conveying cables 220 therethrough, as shown in FIG. 21. Such cables 220 may be any type of cable or wire, such as for electrical power, Internet or ethernet cables, sound or audio-visual cables and the like. The wall panel 100 therefore hides cables 220 that may be needed for lights, sound systems, and other devices that may be used in proximity to the space formed by the wall panels 100 and/or system 200. Utility boxes for plumbing, networking and power, such as outlet boxes and the like, may also be mounted to an interior surface of a wall sheet 150 or to the frame 140 within the hollow formed in the wall panel 100 between wall sheets 150*a*, 150*b*. The connecting plumbing, networking, and power cables, including grounding wires, may be run to the utility box through the frame 140 such as through or between frame components 110 as described below.

Figure 30:
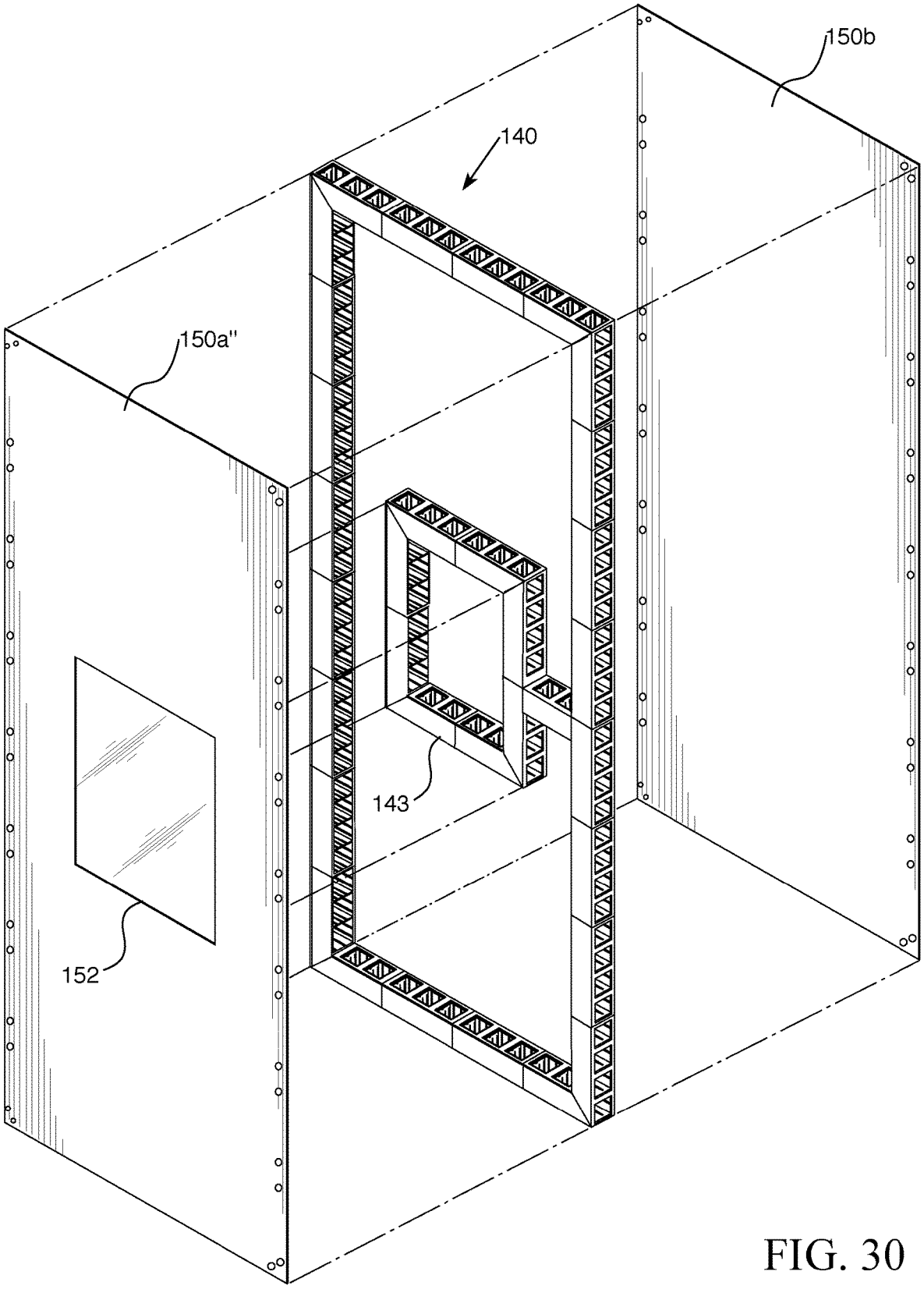
FIG. 30 is an exploded view of another embodiment of a modular wall panel showing a sub-assembly.

With reference to FIGS. 2 and 4-6, the wall panel 100 includes a frame 140 made up of a plurality of frame components 110. As indicated above, the frame 140 forms the skeleton of the wall panel 100, providing the structural support for the wall sheets 150 attached thereto. The frame 140 may be any shape, such as but not limited to rectangular, square, triangular, and others. The frame 140 may also have any configuration, such as intersecting in a radial or grid configuration which may traverse at least a portion of the wall panel 100 and provide support to central portions of the wall sheets 150. Portions of the frame 140 may also form a sub-assembly 143 as shown in FIG. 30 configured to support a feature 152, such as a window, door or screen within a wall sheet 150, as discussed above. In such embodiments, the sub-assembly 143 may have a shape or configuration corresponding to at least a portion of the feature 152. The feature 152 and sub-assembly 143 may be located anywhere on the wall panel 100, though in some embodiments the feature(s) 152 need not be supported by a sub-assembly 143. When present, the sub-assembly 143 may be connected to the remainder of the frame 140 or may be separate from the rest of the frame 140. In at least one embodiment, the frame 140 preferably forms the perimeter, or at least a portion of the perimeter, of each wall panel 100. For instance, the frame 140' in FIG. 4 forms the entire perimeter of the wall panel 100'. In other embodiments, as in FIG. 2, the frame 140 forms only the corners of the wall panel 100.

Any placement or configuration of the frame 140 within the wall panel 100 is contemplated herein. For example, the various frame components 110 that make up the frame 140 may each be contiguous with and touching the next adjacent frame component 110, as in FIG. 4. In other embodiments, only some of the frame components 110 may be touching one another, as in FIG. 2. In some embodiments, some of the frame components 110 may be spaced apart from one another, also as shown in FIG. 2. In still other embodiments, all the frame components 110 may be spaced apart from one another. It should be appreciated that the frame 140 may be formed even when frame components 110 are not contiguous and touching one another. Indeed, the frame components 110 need not be secured or connected to one another to form the frame 140. All that is needed is that they form a support for the wall sheet(s) 150 to affix to. In some embodiments, the frame 140 may be assembled by arranging the frame components 110 on a jig where they "float" until a wall sheet 150 is secured to them, fixing them in place. In such embodiments, complete wall panels 100 may be provided to the end user in the field for assembling into a wall system 200 in the field, as described below. In other embodiments, the frame components 110 may be connected to one another, such as by adhesive, welding, screws, hinges, hook and loop fasteners, corresponding fasteners and receivers, and other types of fastening mechanisms, to secure the frame 140 before the wall sheet(s) 150 is affixed thereto. In these embodiments, the frame 140 and walls sheets 150 may be provided to the end user for assembly in the field.

The frame components 110 used in the frame 140 may be any combination of several types but they all have certain elements in common. For instance, and with reference to FIGS. 7-11 and 14-15, the frame components 110 have several wall components 111, such as a first face wall 112 and opposite second face wall 114 that are spaced apart from one another. In at least one embodiment, the first and second face walls 112, 114 are parallel to one another, though in other embodiments they may be other than parallel. Each frame component 110 also includes a first end 116 and second end 118 located at opposite terminal ends of the face walls 112, 114 and interposed between the face walls 112, 114. The ends 116, 118 may be a solid wall, an open space, or a combination thereof. An outer surface 120 spans between the first and second face walls 112, 114, such as extending transversely between corresponding edges of the first and second face walls 112, 114. In at least one embodiment, the outer surface 120 also extends between the first and second ends 116, 118. Accordingly, the outer surface 120 may connect to corresponding edges of the face walls 112, 114 and the ends 116, 1/8 to cover an entire surface of the frame component 110. An inner surface 122 similarly spans between corresponding edges of the first and second face walls 112, 114 opposite from the outer surface 120. In at least one embodiment, the inner surface 122 may be open to the interior of the frame component 110, as shown in FIGS. 5-8, 16B and 17B. In other embodiments, the inner surface 122 may be at least partially solid, as is the outer surface 120. Accordingly, the outer and inner surfaces 120, 122, face walls 112, 114 and ends 116, 118 form the boundaries of the frame components 110. Each frame component 110 may measure any dimension, such as but not limited to 2-12 inches wide (distance from first end 116 to second end 118), 3 inches deep (distance from first face wall 112 to second face wall 114), and 3 inches high (distance from outer surface 120 to inner surface 122).

In at least one embodiment, as can be appreciated from FIGS. 7-12D and 14-15, the outer surface 120 may extend beyond or over hang the first and second face walls 112, 114 by an amount sufficient to accommodate the wall sheet 150. For instance, the overhang amount may be about the same distance as the thickness of the wall sheet 150 to be affixed to the corresponding face wall 112, 114 that forms the corresponding face 141, 142 of the frame 140 when assembled. By way of example, and not to be limiting, the amount of overhang of the outer surface 120 may be in the range of 0.1-0.11 inches at either face wall 112, 114.

The outer surface 120 includes at least one outer aperture 130 formed therein and spaced apart from one another, as shown in FIGS. 7, 9, 11, and 14. Each outer aperture(s) 130 has a size and shape large enough to receive and accommodate at least a portion of an insert 155 therein, described in further detail below. For instance, the outer aperture(s) 130 may be square, rectangular, circular, ovoid, or asymmetrically shaped as would correspond with a matching insert 155. In at least one embodiment the outer aperture(s) 130 may measure in the range of 0.5 to 4 inches and may be about 2 inches squared in at least one embodiment. There may be any number of outer aperture(s) 130 in each frame component 110, such as one, two, three, four, five, ten and twelve as some non-limiting examples. In one embodiment, each frame component 110 may have four outer apertures 130 formed in the outer surface 120.

Figure 8:
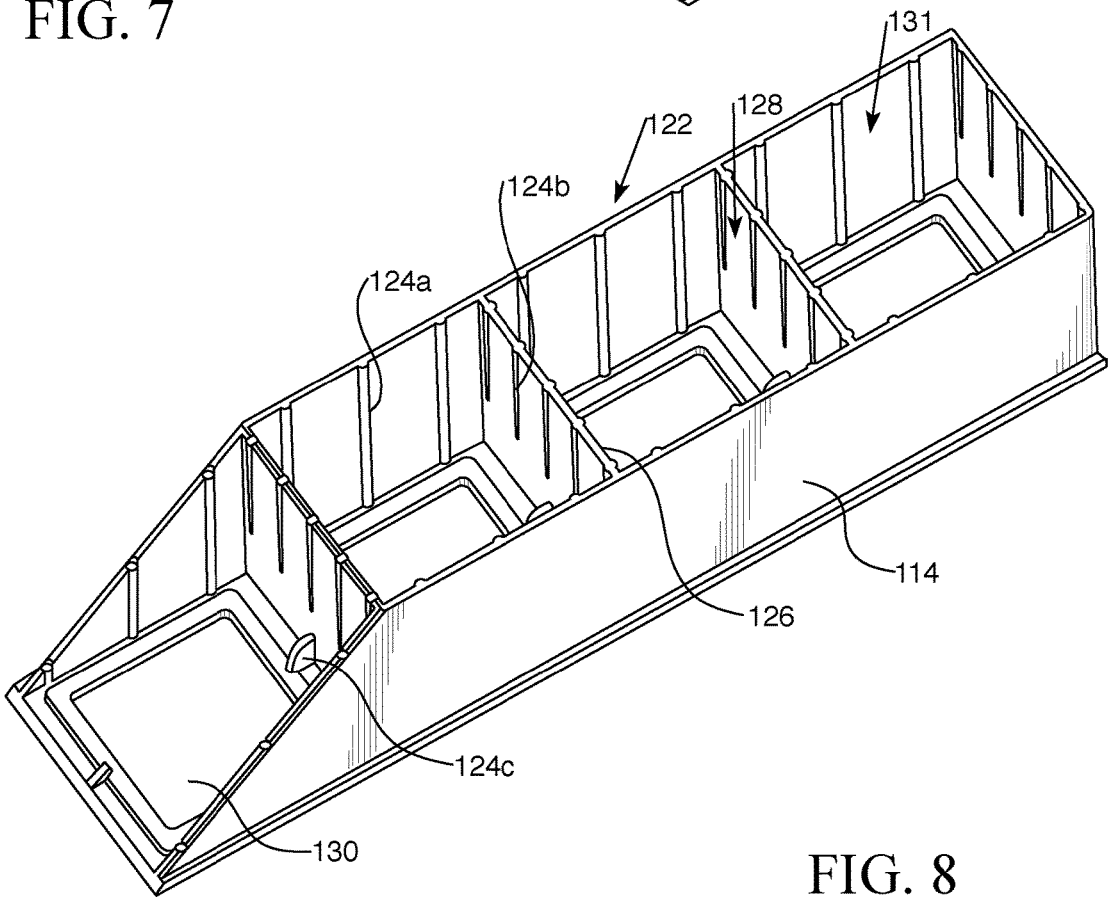
FIG. 8 is a bottom perspective view of the frame component of FIG. 7.
Figure 10:
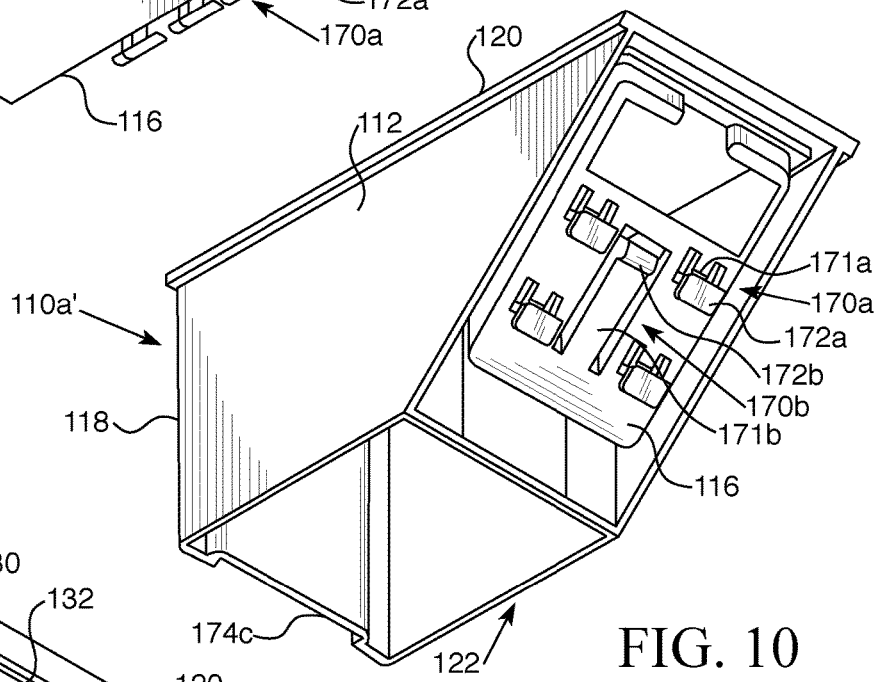
FIG. 10 is a bottom perspective view of the frame component of FIG. 9.
Figure 15:
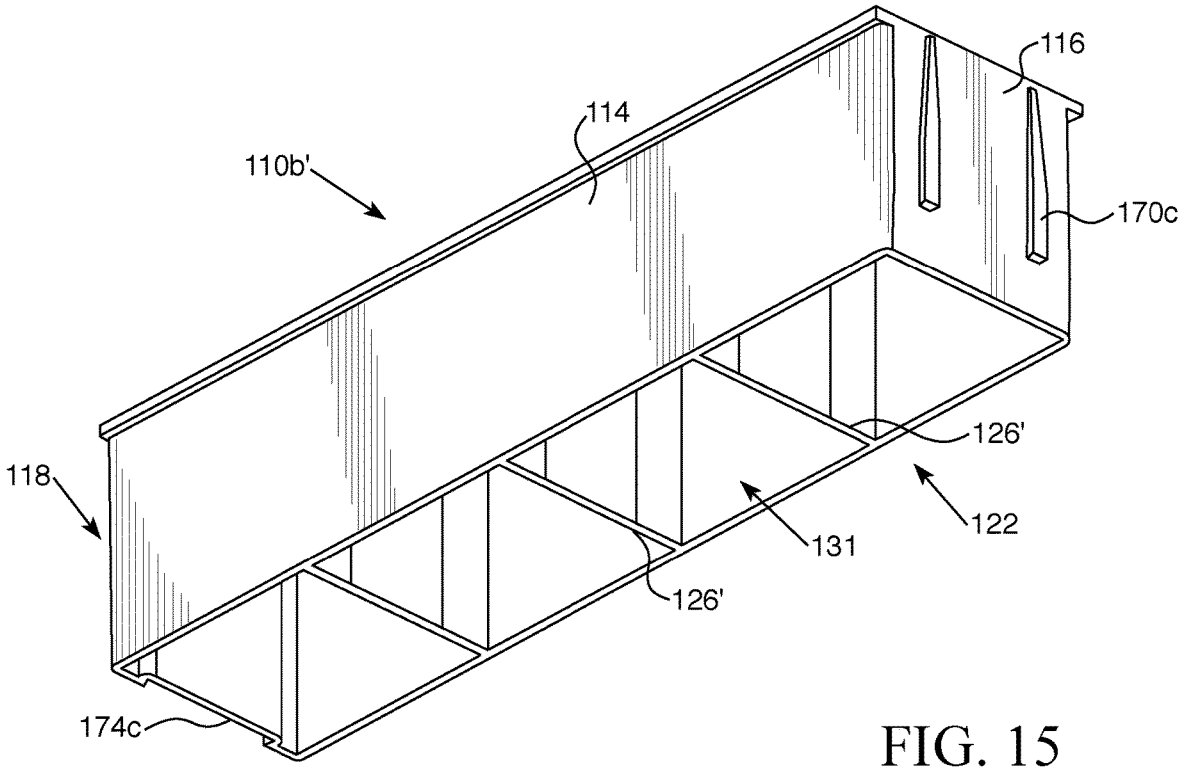
FIG. 15 is a bottom perspective view of the frame component of FIG. 14.

Similarly, the inner surface 122 includes at least one inner aperture 131 formed therein and spaced apart from one another, as shown in FIGS. 8, 10 and 15. Each inner aperture(s) 131 also has a size and shape large enough to receive and accommodate at least a portion of an insert 155 therein. In at least one embodiment, each inner aperture 131 is aligned with a corresponding outer aperture 130, forming a passage 128 therebetween. Accordingly, there are preferably the same number of inner apertures 131 as there are outer apertures 130. In at least one embodiment, each corresponding inner and outer aperture 131, 130 may be substantially the same size, shape and dimension. However, in other embodiments the inner aperture(s) 131 may be larger than the corresponding outer aperture(s) 130.

The passage 128 formed between each corresponding outer and inner aperture 130, 131 is dimensioned to receive and selectively restrain an insert 155 therein. For instance, the frame component 110 may include at least one component wall 111 disposed between the outer and inner surfaces 120, 122 and spaced apart from the ends 116, 118. Such component walls may be a divider(s) 126 which separate adjacent passages 128, as best shown in FIGS. 8 and 15. Accordingly, the divider(s) 126 may have the same height as the rest of the frame component 110. The divider(s) 126 and other component walls 111, such as the interior-facing sides of the face walls 112, 114 and ends 116, 118, if walls. The divider(s) 126 may have the same or similar thickness as the other component walls 111, such as in the range of about 0.07-0.15 inches. In at least one embodiment, the divider(s) 126 may be thicker or thinner than the outer component walls 111. For instance, the outer component walls 111 may have a thickness in the range of 0.06-0.1 inches. These are a few non-limiting examples for illustrative purposes only.

Figure 7:
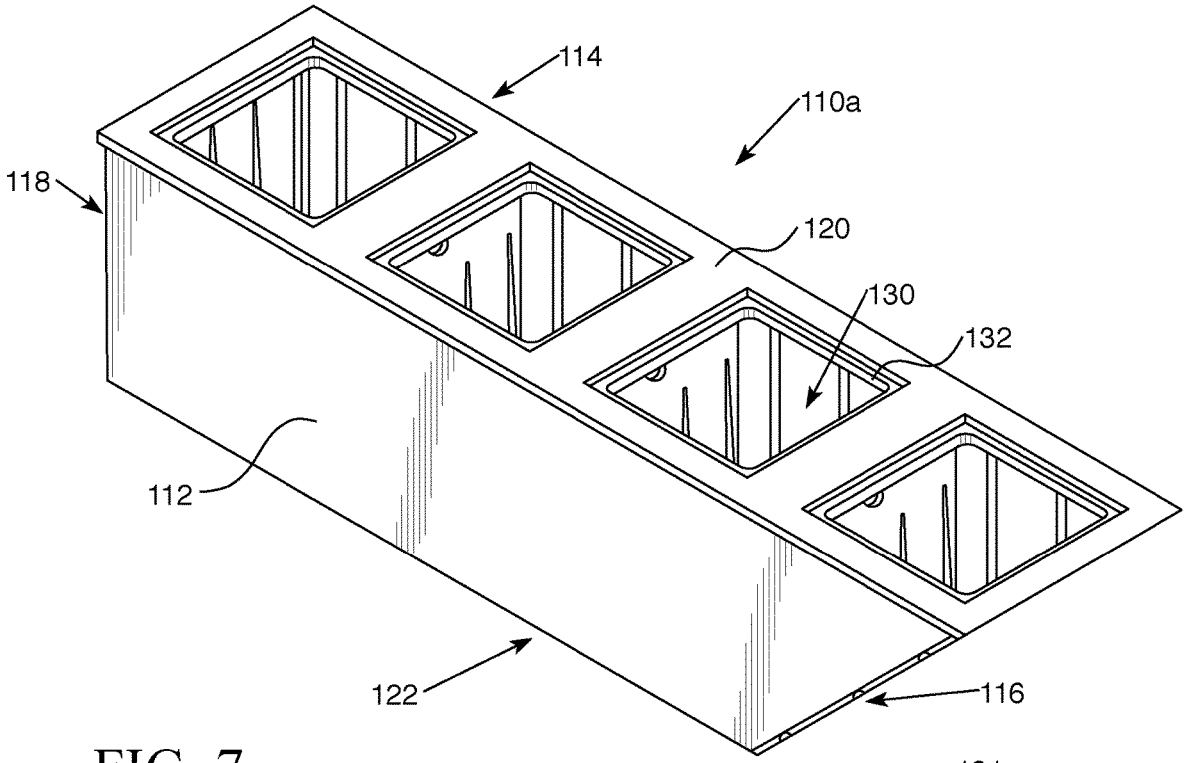
FIG. 7 is a top perspective view of one embodiment of a frame component as may be used in the modular wall panel.

In some embodiments, such as shown in FIGS. 7 and 8, the frame components 110 may include at least one support rib 124 extending outwardly from a wall 111 or divider 126 in which they are formed. As such, they provide structural support to the corresponding wall 111 or divider 126, and therefore to the wall panel 100 overall. They may also provide frictional engagement with an insert 155 placed within a passage 128 into which a support rib 124 extends. Accordingly, in at least one example the support ribs 124 may extend longitudinally along the interior wall surfaces of the frame component 110, such as between the outer and inner surfaces 120, 122, to be aligned with the direction of insertion and removal of inserts 155 therein. In other examples, however, at least some of the support ribs 124 may extend along the interior wall surfaces of the frame component 110 between adjacent walls which may be other than longitudinal. There may also be different types of support ribs 124. For example, and as depicted in FIG. 8, the frame component 110 may include support ribs 124*a* that extend the entire height of the component walls 111 such as the interior surface of the face walls 112, 114. These full support ribs 124*a* may have a uniform thickness or dimension or may have a varying thickness along its length. Some support ribs 124*b* may be a partial rib that extends only a fraction of the height of the frame component 110. These partial support ribs 124*b* may be tapered, as depicted, or may have a uniform dimension throughout. Other support ribs 124*c* may span between walls, such as between one side of a divider 126 and the underside of the outer surface 120 as shown in FIG. 8. As such, the support ribs 124*c* may be fins, fans, or other geometric structure to reinforce a junction of walls and provide further support. These are a few non-limiting examples. In other embodiments, such as in. FIG. 15, the dividers 126 may lack support ribs 124 but rather rely on other elements for structural rigidity, such as fasteners 170 and receivers 174 discussed below.

As shown in FIGS. 7-9, 11 and 15, the outer surface 120 may also include at least one countersunk portion 132 associated with an outer aperture 130. For example, a countersunk portion 132 may be disposed along at least a portion of the perimeter of an outer aperture 130, such as surrounding a corner(s) of the outer aperture 130 or fully or partially surrounding the outer aperture 130. The countersunk portion 132 is dimensioned to receive a portion of the insert 155 therein. For example, the insert 155 may be a cap 160 having at least one lug portion 162 extending from a cover 166, as described below. The countersunk portion 132 may be dimensioned to receive the cover 166 when the lug portion 162 is received within the corresponding outer aperture 130. In at least one embodiment, the countersunk portion 132 has depth similar in dimension to the thickness of the cover 166, such as but not limited to about 0.075 inches. It may also have a lateral dimension similar to that of the cover 166, which may be wider than the outer aperture 130 into which it is inserted. Accordingly, in at least one embodiment, the countersunk portion 132 provides a planar fit of the cap 160 into the outer aperture 130 such that the cover 166 is substantially co-planar with the surrounding outer surface 120 of the frame component 110 when the cap 160 is placed fully within the outer aperture 130 and passage 128.

Figure 5:
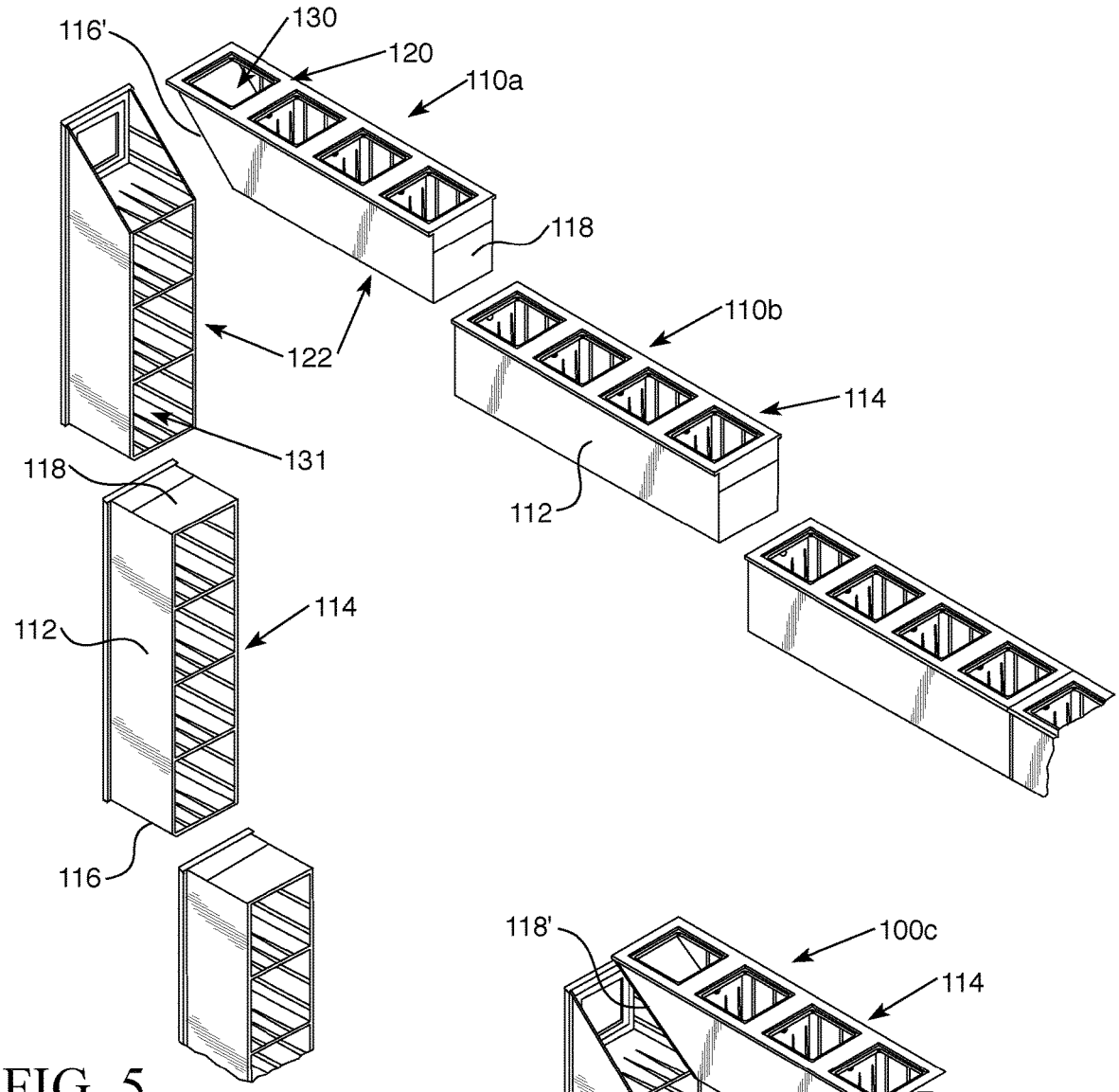
FIG. 5 is an exploded view of an arrangement of frame components of another exemplary embodiment of the modular wall panel.
Figure 13A:
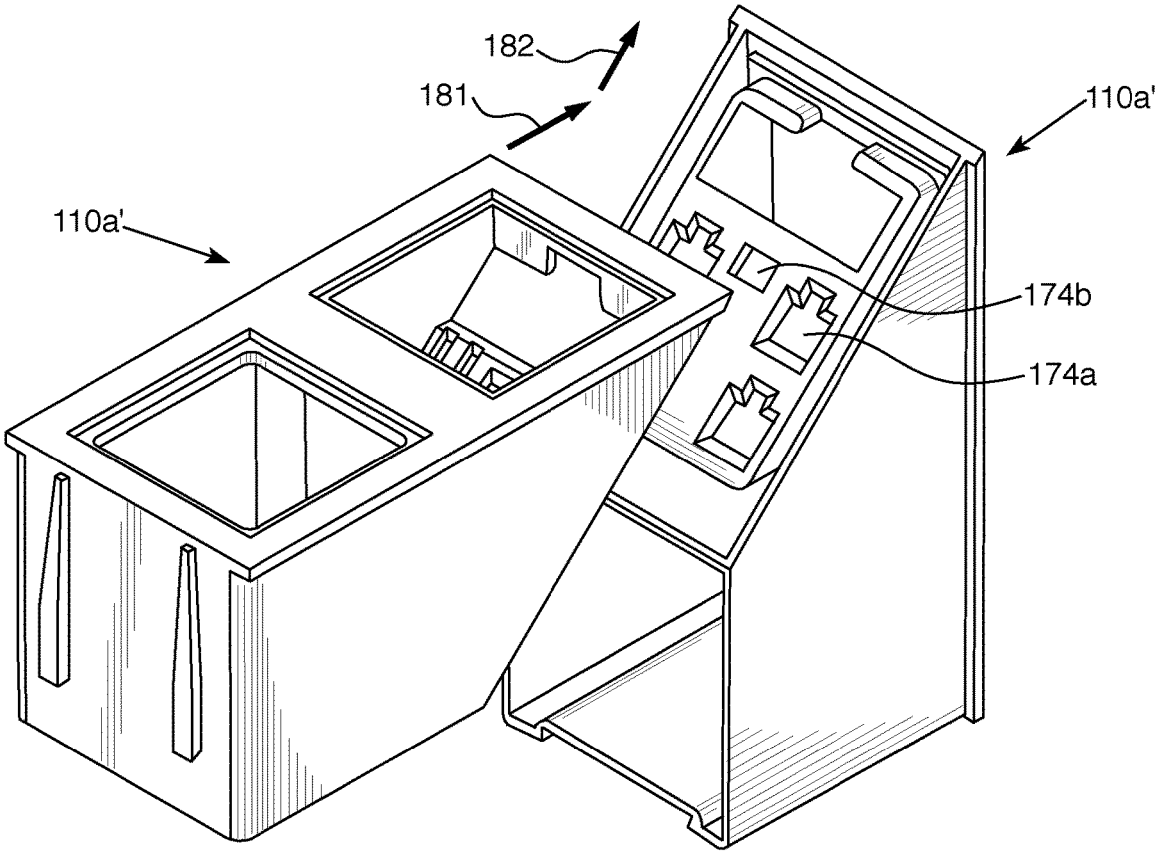
FIG. 13A is a perspective view showing two frame components aligned for engagement.
Figure 13B:
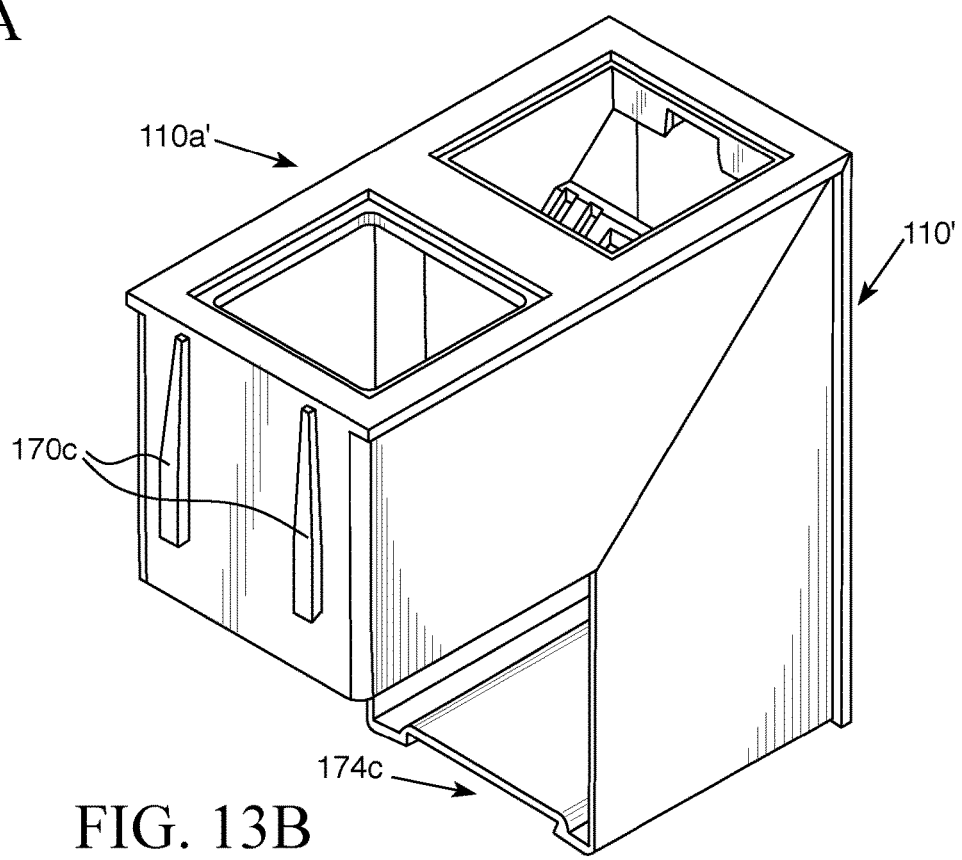
FIG. 13B is a perspective view of the two frame components of FIG. 13A secured together to form a corner assembly.

As mentioned previously, there may be many varieties of frame components 110. For example, a first type of frame component may be a combination frame component 110*a*, as illustrated in FIGS. 7 and 8, or frame component 110*a*' as in FIGS. 9-11 and 13A-13B. Combination frame components 110*a*, 110*a*' have one end 118 that is substantially perpendicular to the outer and inner surfaces 120, 122, and one end 116 that is angled relative to the outer and inner surfaces 120, 122. Accordingly, each face wall 112, 114 may have an angled end. The angled end 116 may be at any oblique angle relative to the outer surface 120, such as an acute angle in the range of 10°-80°. In at least one embodiment, the angled end 116 is at about 45° angle relative to the outer surface 120. Two angled frame components 110*a* may be joined together at their angled ends 116 to form a corner of a frame 140, as depicted in FIGS. 5, 13A and 13B. In still other embodiments, the oblique angle may be an obtuse angle relative to the outer surface 120.

Figure 16A:
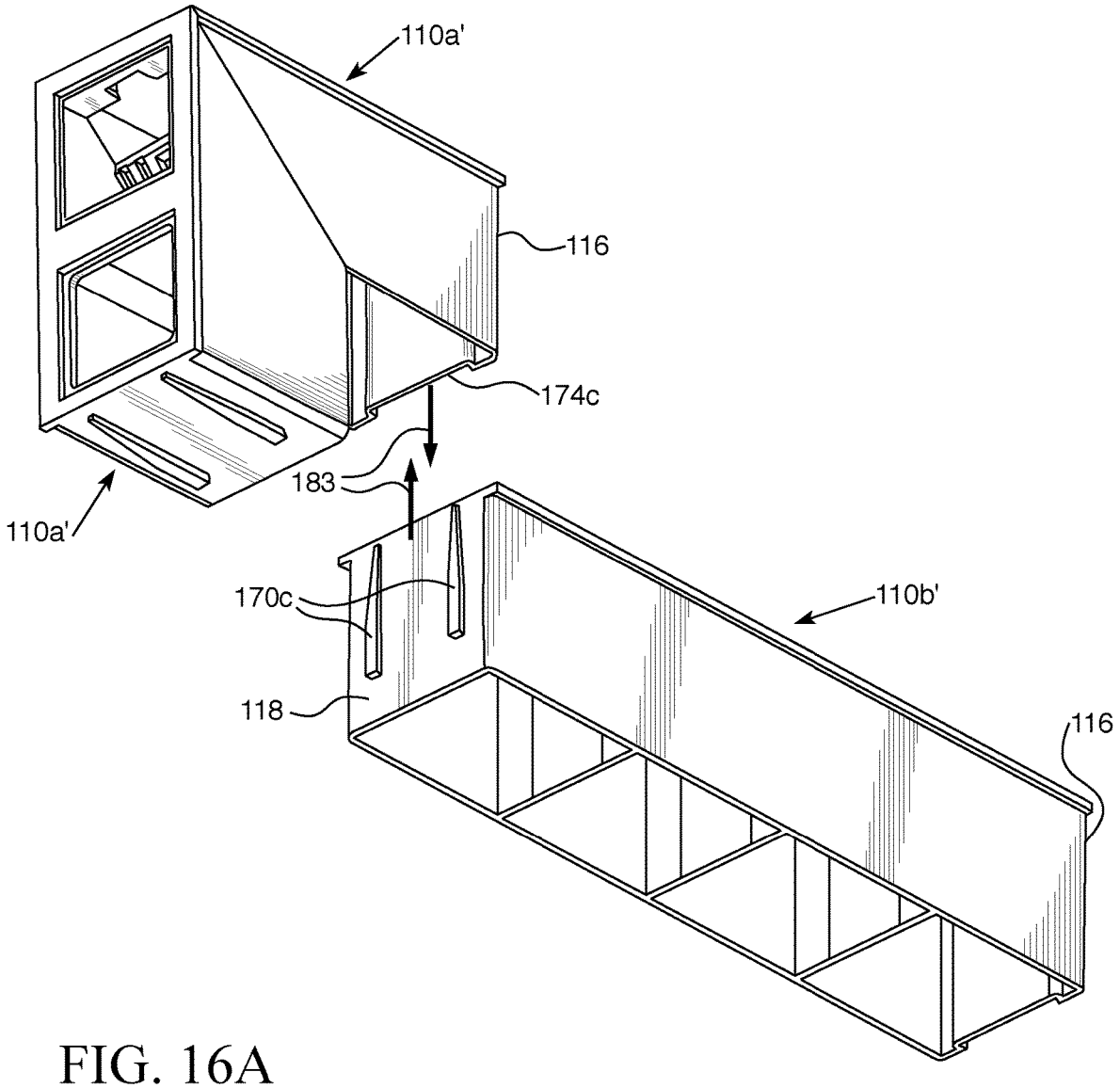
FIG. 16A is a perspective view showing a corner assembly as in FIG. 13B aligned for engagement with a frame component as in FIG. 14.
Figure 16B:
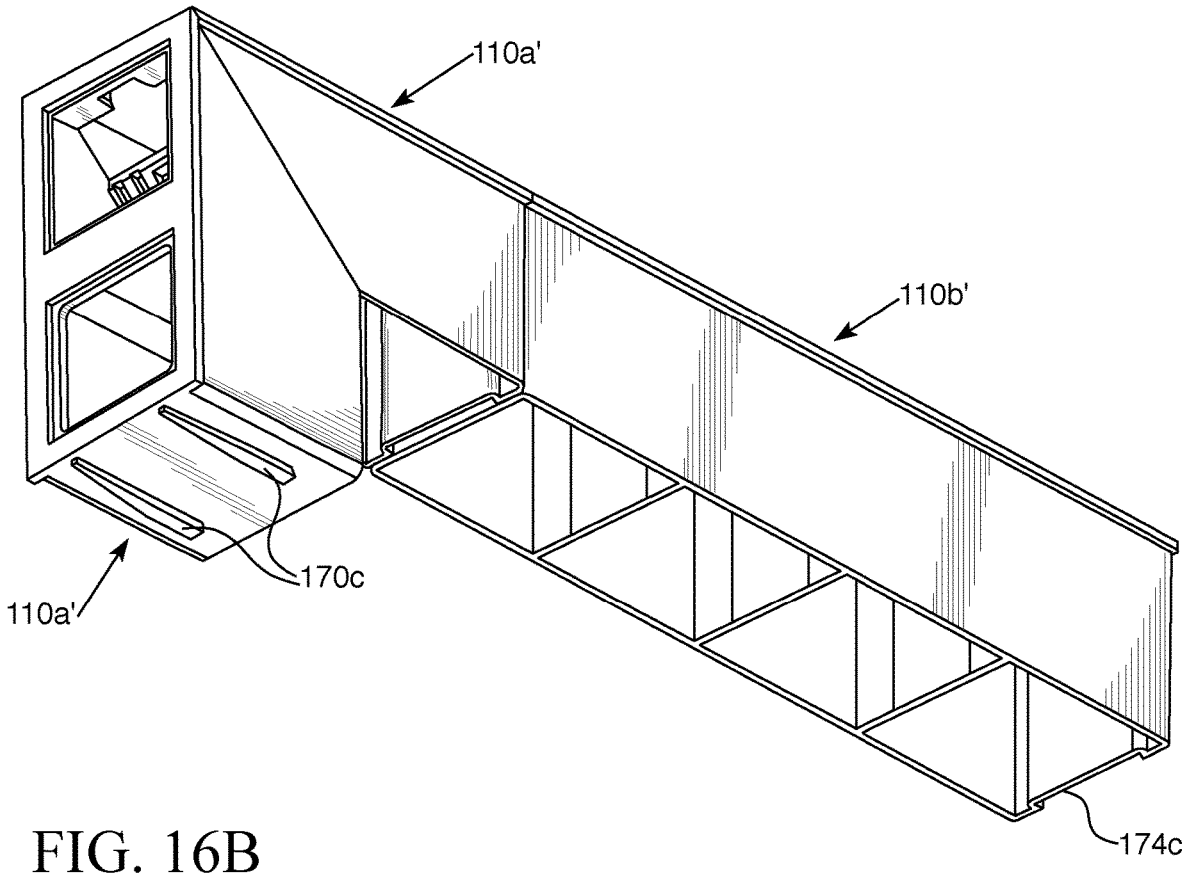
FIG. 16B is a perspective view of the corner assembly and frame component of FIG. 16A secured together.
Figure 17A:
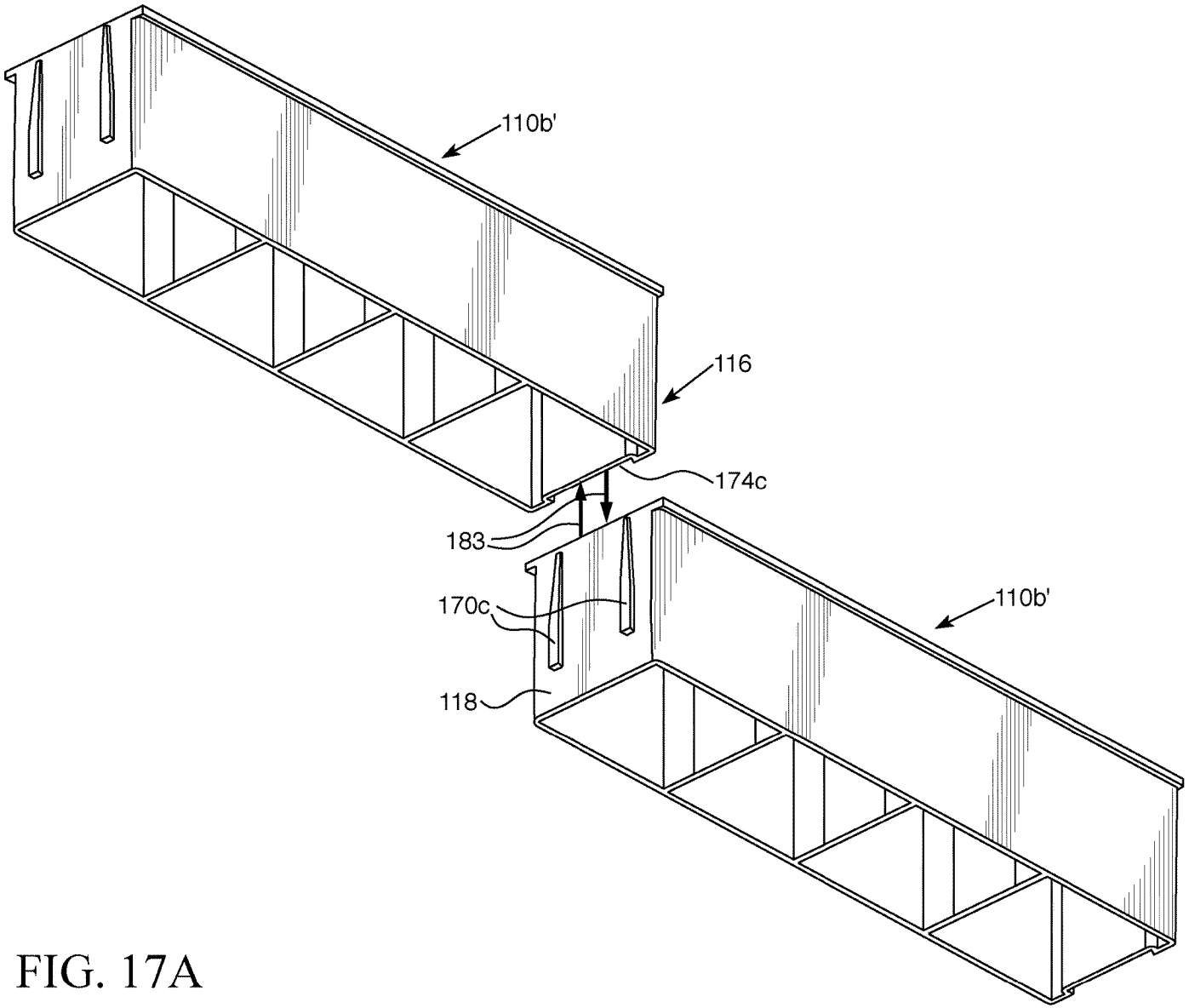
FIG. 17A is a perspective view showing two frame components as in FIG. 14 aligned for engagement with one another.
Figure 17B:
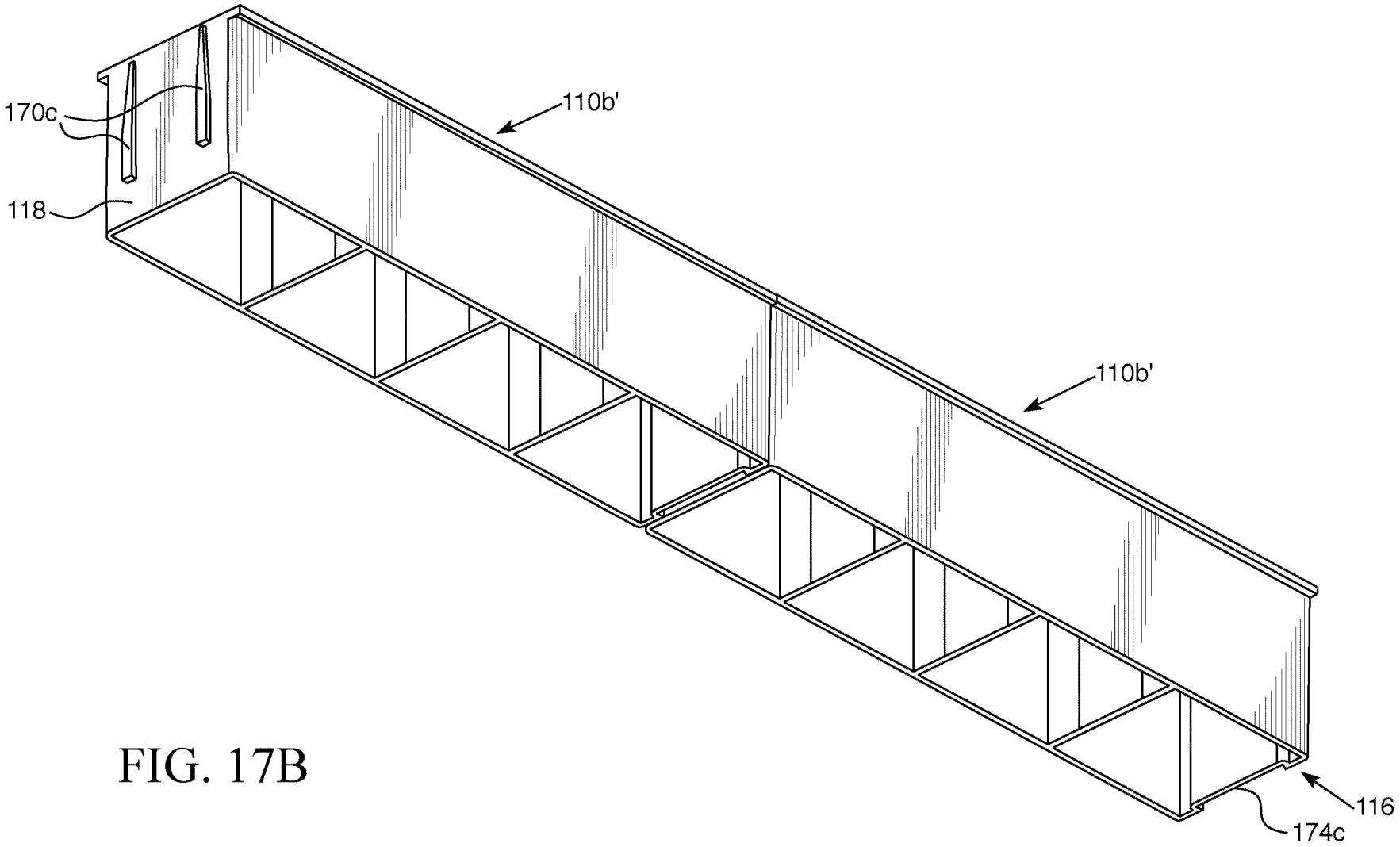
FIG. 17B is a perspective view of the two frame components of FIG. 17A secured together.

A second type of frame components, such as straight frame components 110*b* as shown in FIG. 5 and frame components 110*b*' as shown in FIGS. 14-17B, have both ends 116, 118 that are substantially perpendicular to the outer and inner surfaces 120, 122. The straight ends 116, 118 may be substantially perpendicular in that some slight deviation from 90° may be tolerated and still considered straight, such as to allow for drafting between adjacent frame components 110*b*, 110*b*'. These straight frame components 110*b*, 110*b*' may be used to extend the frame 140 in any direction, as shown in FIGS. 5, 16B and 17B.

Figure 6:
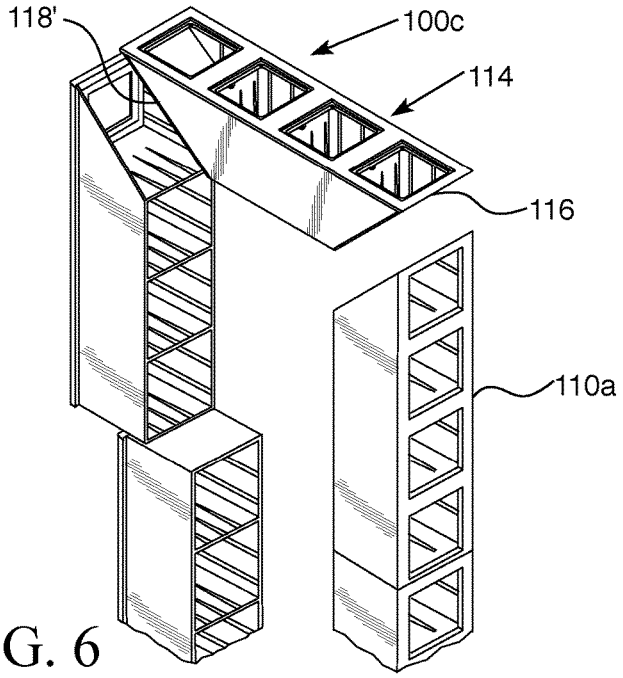
FIG. 6 is an exploded view of an arrangement of frame components of the modular wall panel of FIG. 3.

A third type of frame components 110*c* have both ends 116, 118 that are angled relative to the outer and inner surfaces 120, 122, as depicted in FIG. 6. The angled ends 116, 118 may have the same angle or different angles from one another. In at least one embodiment, both angled ends 116, 118 may be in the range of 10°-80° and in at least one preferred embodiment may be about 45° relative to the outer surface 120. Such angled frame components 110*c* may be used to form an end of a frame 140 that is intended to be as narrow as the width of a single frame component, such as shown in FIG. 6.

Figure 9:
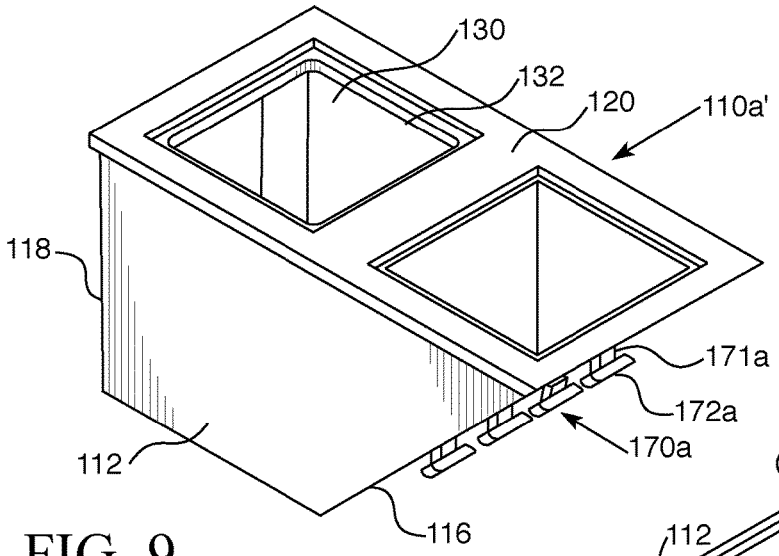
FIG. 9 is a top perspective view of a second embodiment of a frame component which may be used in the modular wall panel.
Figure 11:
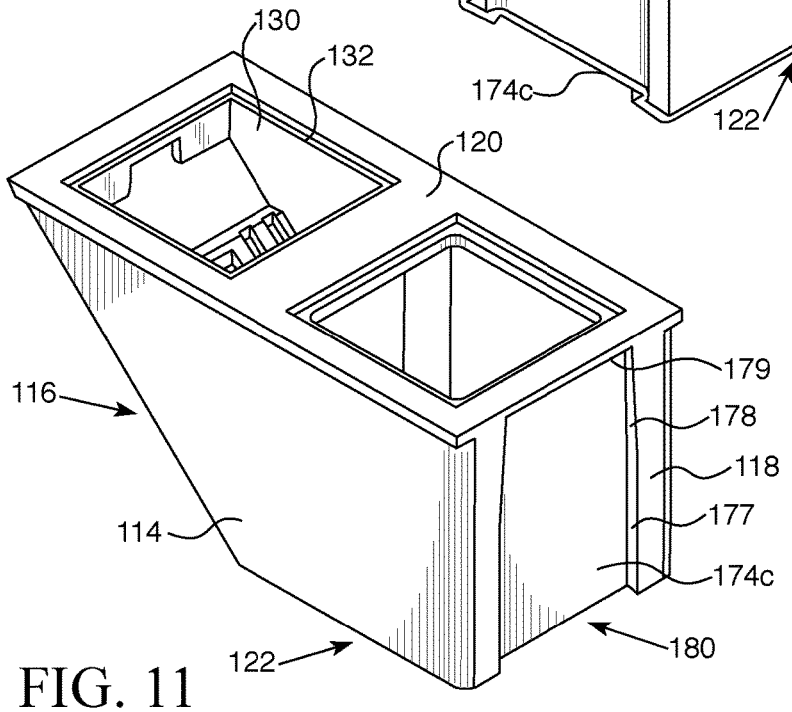
FIG. 11 is a perspective view of the frame component of FIG. 9 from the second side.
Figure 14:
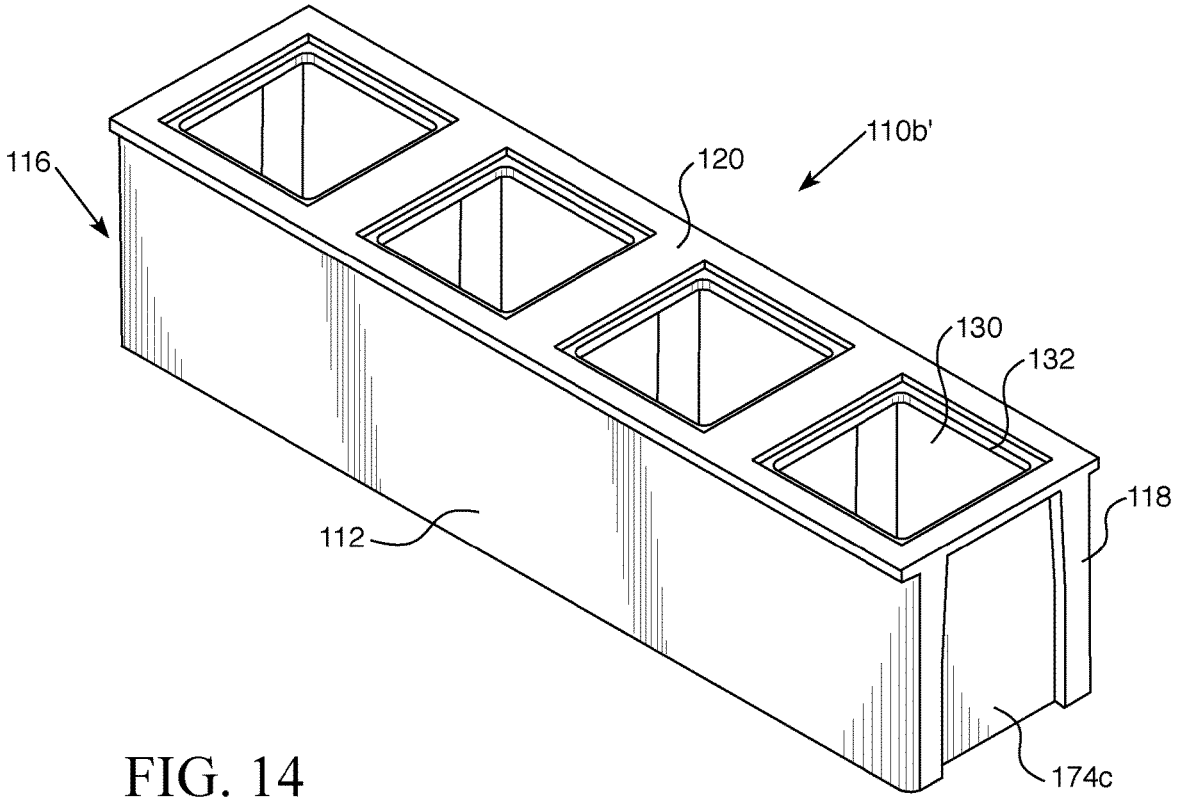
FIG. 14 is a top perspective view of a third embodiment of a frame component which may be used in the modular wall panel.

In some embodiments, the frame components 110' may have at least one fastener 170 or receiver 174 on at least one end 116, 118 to facilitate connection of frame components 110' to one another. In such embodiments, the fastener(s) 170 are correspondingly configured to selectively engage respective receiver(s) 174 on an adjacent frame component 110', and vice versa. Any combination of fasteners 170 and receivers 174 in various placements on the frame components 110' are contemplated herein. For instance, in a first embodiment the frame component 110' may have fasteners 170 on either the first or second ends 116, 118 and receivers 174 on the other first or second end 116, 118, such as depicted in FIGS. 9-11 and 14-15. In a second embodiment, the frame component 110' may have fasteners 170 on both first and second ends 116, 118. In a third embodiment, the frame component 110' may have receivers 174 on both first and second ends 116, 118. Either such first or second ends 116, 118 could be angled or straight, as previously described, in any of the above embodiments. For instance, FIGS. 9-11 show a frame component 110*a*' having an angled first end 116 with fasteners 170 and straight second end 118 having a receiver 174. FIGS. 14-15 show a frame component 110*b*' where both ends 116, 118 are straight but the first end 116 has fasteners 170 and the second end 118 has a receiver 170. In at least one embodiment the fasteners 170 may be integrally formed with the corresponding frame component 110', such as but not limited to by molding, milling, pressing, or deposition. In other embodiments, the fasteners 170 may be securely attached to the corresponding frame component 110', such as but not limited to by adhesive or bonding. The receivers 174 may be formed in the corresponding frame component 110', such as but not limited to by molding, milling, or other formation or removal techniques.

There may be various types of fasteners 170 and receivers 174, such as but not limited to those shown in FIGS. 12A-12D. Regardless of particular embodiment, each fastener 170 includes a stem 171 and an engagement portion 172. In at least one embodiment the stem 171 and engagement portion 172 are integrally formed. In other embodiments, the stem 171 and engagement portion 172 may be securely attached to one another to form the fastener 170. The stem 171 has a length and may extend along or away from the surface of the end 116, 118. The engagement portion 172 may be located along the length of the stem 171, such as preferably at the terminal end thereof. The engagement portion 172 may be a projection, tab or other protruding member that is configured to contact, engage and hold at least a portion of a corresponding receiver 174 to selectively secure the frame component 110' to the adjacent frame component 110'. The stem 171 is therefore configured to facilitate the positioning the engagement portion 172 of the fastener 170 relative to a corresponding receiver 174 for selective connection and securement.

In addition, the fastener 170 may be made of any suitable material, which may be the same or different from that of the frame component 110', such as but not limited to polymers, plastics, metals, metal alloys, wood, or other materials described above for frame components 110. In some embodiments, at least a portion of the fasteners 170 may be made of a rigid material or construction that resists deformation and provides structural integrity for connection. In some embodiments, at least a portion of the fasteners 170 may be made of resilient material, such as by being made of a more pliant material such as but not limited to plastics and polymeric materials. In some embodiments, a portion of the fastener 170 may be resilient as a result of having a biased construction or configuration such as tension-biased or spring biased. Regardless of how resiliency is achieved, at least a portion of the fastener 170 may be able to temporarily deflect or deform under pressure then return to its native position once pressure is released. The fasteners 170 may also be made of a combination of rigid and resilient or flexible materials. For instance, in at least one embodiment at least a portion of the stem 171 may be resilient or at least partially resilient for flexing and deflecting as needed, and the engagement portion 172 may be more rigid.

Figure 12A:
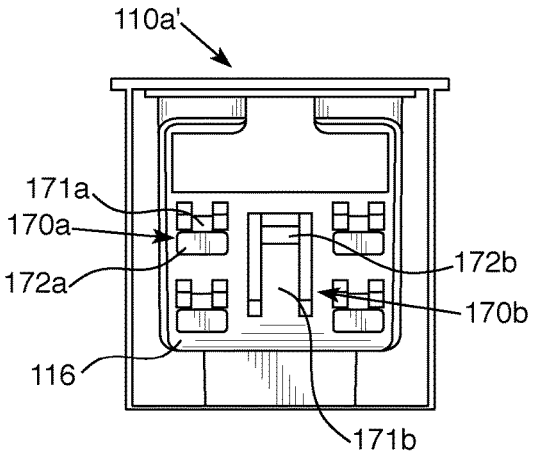
FIG. 12A is an elevation view of a first embodiment of an end of a frame component, showing first and second embodiments of fasteners.

With reference to FIG. 12A, a first embodiment of fastener 170*a* includes a stem 171*a* extending away from the surface of the end 116 and terminating in an engagement portion 172*a*. In this embodiment, the engagement portion 172*a* has a wider dimension than the stem 171*a*, although in other embodiments the stem 171*a* may have a wider dimension than the engagement portion 172*a*, or they may have substantially the same dimension as one another. This type of fastener 170*a* may be useful in aligning the frame component 110' for connection to an adjacent frame component 110'. Such fasteners 170*a* may be made of a rigid material or construction that resists deformation and protrudes from the surface of the end 116, including the stem 171*a* and engagement portion 172*a*. There may be any number of fasteners 170*a* on the same end 116 and/or on a second end 118.

FIG. 12A also shows a second embodiment of fastener 170*b* in which the stem 171*b* extends along the surface of the end 116, 118 and is substantially co-planar therewith. The stem 171*b* may be tension-biased or spring-biased to deform slightly upon the application of pressure from a resting position to at least one deflected position. For instance, the stem 171*b* may be connected to the first end 116 at one end thereof and have a free opposite end, allowing the stem 171*b* to at least partially deflect or bend at or near the end which joins to the first end 116 when pressure is applied. Any number of deflected positions may be achieved depending on the amount of pressure applied. The stem 171*b* may bias against the direction of pressure such that it returns automatically to its resting position co-planar with the surface of the end 116, 118 when the pressure is removed. An engagement portion 172*b* may be located at the free end of the stem 171*b*. The engagement portion 172*b* protrudes beyond the plane of the end 116, forming a lip, tab or other similar shape to engage a portion of a corresponding receiver 174. Accordingly, the fastener 170*b* may provide a snap-fit engagement with a corresponding receiver 174.

Figure 12C:
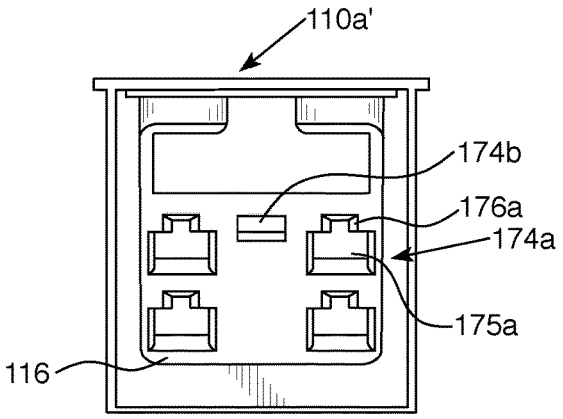
FIG. 12C is an elevation view of a third embodiment of an end of a frame component, showing first and second embodiments of receivers corresponding to the fasteners of FIG. 12A, respectively.
Figure 12B:
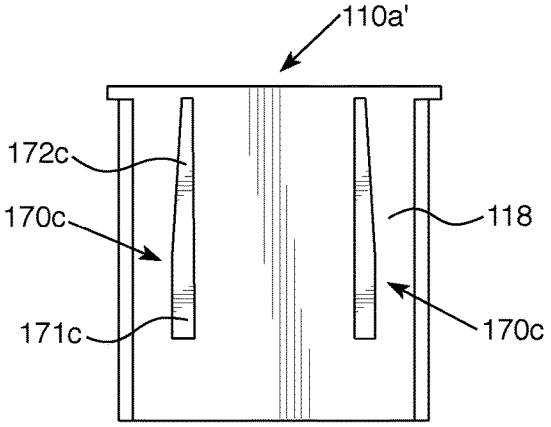
FIG. 12B is an elevation view of a second embodiment of an end of a frame component, showing a third embodiment of fasteners.

FIG. 12B shows a third embodiment of a fastener 170*c* which extends along the surface of an end 118 and in which both the stem 171*c* and engagement portion 172*c* protrude or extend away from the surface of the end 118. In this embodiment, the stem 171*c* and engagement portion 172*c* may be co-extensive with each other, protruding the same distance from the surface of the second end 118. In some embodiments the engagement portion 172*c* may be angled such as to have a narrower width dimension than the stem 171*c*, or may have a varying width dimension over its length so the engagement portion 172*c* is the same width as the stem 171*c* at the point at which they are adjacent but the engagement portion 172*c* may become increasingly narrower with increased distance from the stem 171*c*. In other embodiments, however, it may be the stem 171*c* that narrows compared to the width of the engagement portion 172*c*.

FIG. 12C shows a first embodiment of a receiver 174*a* having a first portion 175*a* and second portion 176*a*. The first and second portions 175*a*, 176*a* may have different dimensions, such as width dimensions, and may be configured to receive different parts of the fastener 170. For instance, the first portion 175*a* may be dimensioned and configured to receive the engagement portion 172*a* of a corresponding fastener 170*a*, and therefore may be wider than the second portion 176*a* of the receiver 174*a*. The second portion 176*a* of the receiver 174*a* may be dimensioned and configured to receive the stem 171*a* of a corresponding fastener 170*a* while restricting passage of the engagement portion 172*a* of the fastener 170*a* therethrough. Accordingly, the receiver 174*a* may be configured to selectively receive and retain a corresponding fastener 170*a*.

To connect, the engagement portion 172*a* of the fastener 170*a* is inserted into and through the first portion 175*a* of the receiver 174*a*, until the stem 171*a* of the fastener 170*a* is aligned with the second portion 176*a* of the receiver 174*a*. The associated frame components 110' are then moved relative to one another so the stem 171*a* of the fastener 170*a* is moved into to the second portion 176*a* of the receiver 174*a*. At this point, the wider dimension of the engagement portion 172*a* of the fastener 170*a* compared to the second portion 176*a* of the receiver 174*a* retains the fastener 170*a* in the receiver 174. To connect frame components 110*a*' having at least one such fastener 170*a* and receiver 174*a*, a first frame component 110*a*' having a fastener 170*a* is moved toward a second frame component 110*a*' having a corresponding receiver 174*a* with the fastener 170*a* and receiver 174*a* facing one another, in the direction of arrow 181 in FIG. 13A. Once the engagement portion 172*a* of the fastener 170*a* has passed through the first portion 175*a* of the receiver 174*a*, the frame components 110*a*' are abutting and contacting one another at their respective first and second ends 116, 118. Then one or both of the first and second frame components 110*a*' are moved relative to the other, such as in the direction of arrow 182 in FIG. 13A, to move the stem 171*a* of the fastener 170*a* into the second portion 176*a* of the receiver 174*a*, preferably until further movement is stopped by the dimensions of the second portion 176*a*. At this point, the frame components 110*a*' are securely connected, as shown in FIG. 13B. This connection may be selectively released by reversing the movements to release the fastener 170*a* from the receiver 174*a*. A second embodiment of a receiver 174*b* is also shown in FIG. 12C. In this embodiment, there may only be a single opening dimensioned to receive and retain a protruding portion of a corresponding fastener 170*b* therein. For instance, the receiver 174*b* is dimensioned to receive the engagement portion 172*b* of the fastener 170*b* for a snap fit. To connect, a frame component 110*a*' having a fastener 170*b* is brought into contact with the end 118 of another frame component 110*a*' having a corresponding receiver 174*b* by movement along directional arrow 181, as shown in FIG. 13A. When adjacent frame components 110*a*' are in contact, the end 118 of the frame component 110*a*' having the receiver 174*b* presses against the engagement portion 172*b* of the fastener 170*b* on the other frame component 110*a*'. This pressure causes the stem 171*b* of the fastener 170*b* to temporarily deflect inwardly away from the end 116 of the corresponding frame component 110*a*', moving the fastener 170*b* out of its resting position and into a deflected position. As the frame component(s) 110*a*' are moved relative to one another along directional arrow 182, the engagement portion 172*b* comes into alignment with the corresponding receiver 174*b* on the facing frame component 110*a*'. When engagement portion 172*b* of the fastener 170*b* and the receiver 174*b* are fully aligned, the pressure on the engagement portion 172*b* is released, allowing the stem 171*b* to return to its native resting position and moving the engagement portion 172*b* in the direction of and through the receiver 174*b*. In this position, as shown in FIG. 13B, the engagement portion 172*b* of the fastener 170*b* extending through the receiver 174*b* prevents the attached frame components 110*a*' from sliding or moving relative to one another in the direction counter to arrow 182 until the engagement portion 172*b* is removed from the receiver 174*b*. Similarly, the dimensions of the receiver 174*b* prevent further movement of the engagement portion 172*b* beyond its boundaries, thereby limiting the movement of the frame components 110*a*'. This provides a secure connection until such time as it is desired to be released, at which point the stem 171*b* may be pulled away from the receiver 174*b* until the engagement portion 172*b* is free from the receiver 174*b*. The frame components 110' can then be moved relative to one another to separate.

Figure 12D:
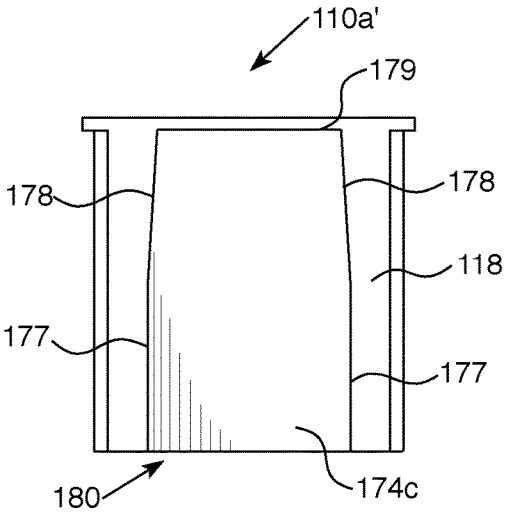
FIG. 12D is an elevation view of a fourth embodiment of an end of a frame component, showing a third embodiment of receiver corresponding to the fasteners of FIG. 12B.

A third embodiment of the receiver 174*c* is shown in FIGS. 12D and 11. In this embodiment, the receiver 174*c* may be configured as a recess in the second end 118, although in other embodiments it could be in the first end 116 as noted previously. The receiver 174*c* may include at least one wall that defines the boundaries of the receiver 174*c*. There may be multiple contiguous walls that collectively define the boundaries of the receiver 174*c*, as in FIG. 12D. For instance, there may be at least one first wall 177 contiguous with at least one second wall 178. A third wall 179 may be contiguous with and transverse to the second walls 178 to form a backstop. There may be a pair of first walls 177 opposite one another, each contiguous with a different one of a pair of second walls 178 also opposite one another, which in turn are both contiguous with and transverse to a third wall 179 connecting the second walls 178. An opening 180 may be formed in the receiver 174*c* opposite the third wall. The walls may be any shape, size or configuration but in at least one embodiment, as shown in FIGS. 11 and 12D, the first walls 177 may be straight and parallel to one another, the second walls 178 may be angled or diagonal relative to the first and third walls 177, 179 such that the receiver 174*c* is at least partially tapered in configuration.

To connect corresponding fasteners 170*c* with receiver 174*c*, a frame component 110*a*' having a fastener 170*c* is brought into contact with the end 118 of another frame component 110*b*' having a corresponding receiver 174*c* by movement along directional arrows 183, as shown in FIG. 16A. The fasteners 170*c* are aligned with the receiver 174*c* such that the narrower portion of the fasteners 170*c* are closer to the opening 180 of the receiver 174*c*. As the frame components 110*a*', 110*b*' are moved relative to one another along directional arrows 183, the narrow end of the fasteners 170*c* enter the opening 180 of the receiver 174*c* first. With further movement in direction 183, the fasteners 170*c* progress further into the receiver 174*c* until the engagement portions 172*c* of the fasteners 170*c* contact the second and third walls 178, 179 of the receiver 174*c* and the stems 171*c* of the fasteners 170*c* contact the first walls 177 of the receiver 174*c*. The third wall 179 stops further movement. When so engaged, the engagement portions 172*c* and stems 171*c* form a snug frictional fit with the second walls 178 and first walls 177, respectively, of the receiver 174*c*. This frictional fit retains the fasteners 170*c* in the receiver 174*c* until force is applied in reverse direction to remove the fasteners 170*c* from the receiver 174*c*. The fasteners 170*c* and receiver 174*c* are correspondingly dimensioned to one another to form this frictional fit when engaged. Specifically, the second walls 178 of the receiver 174*c* are at substantially the same or similar angle of that of the engagement portions 172*c* of the corresponding fasteners 170*c*. Similarly, the first walls 177 of the receiver 174*c* are at substantially the same or similar angle as that of the stems 171*c* of the corresponding fasteners 170*c*. In the embodiments shown in FIGS. 12B and 12D, the second walls 178 and engagement portions 172*c* are angled relative to the first walls 177 and stems 171*c*, respectively, forming a tapered configuration in the fasteners 170*c* and receiver 174*c*. The tapered configuration may facilitate insertion of the fasteners 170*c* into the receiver 174*c*. However, in other embodiments, the engagement portions 172*c* and second walls 178 may be straight such that the fasteners 170*c* and receiver 174*c* have more of a square or rectangular configuration with little or no angling. Any configuration is contemplated so long as the fasteners 170*c* and receiver 174*c* are correspondingly dimensioned for selective engagement to attach adjacent frame components 110*a*', 110*b*'.

There may be any number of fasteners 170 or receivers 174 on the ends of frame components 110', in any combination thereof. For instance, an end 116, 118 may have both fasteners 170 and receivers 174, or may have only fasteners 170 or receivers 174. Likewise, the fasteners 170 and receivers 174 depicted in FIGS. 12A-12D may be included on any type of frame component 110', such as frame components 110*a*' having an angled end as in FIGS. 9-11, 13A-13B and 16A-16B, as well as frame components 110*b*' having both straight ends as in FIGS. 14-17B. Accordingly, the fasteners 170*a*, 170*b*, 170*c* are interchangeable with each other and on the ends 116, 118 regardless of whether the ends 116, 118 are angled or straight end. Similarly, the receivers 174*a*, 174*b*, 174*c* are likewise interchangeable with each other and on ends 116, 118 regardless of whether angled or straight, so long as the corresponding fastener 170 and receiver 174 on adjacent frame components 110' may be aligned and joined. Therefore, the fasteners 170 and receivers 174 can be used to connect frame components 110*a*' together to form a corner of a frame 140, as in FIGS. 13A-13B, to form or extend a straight leg of the frame 140 as in FIGS. 17A-17B, and to connect corners and legs of the frame 140 as in FIGS. 16A-16B. In this manner, the fasteners 170 and receivers 174 facilitate connection of frame components 110*a*', 110*b*' to form a frame 140 in a fully customizable manner and which can be performed in the field by an end user.

Figure 18:
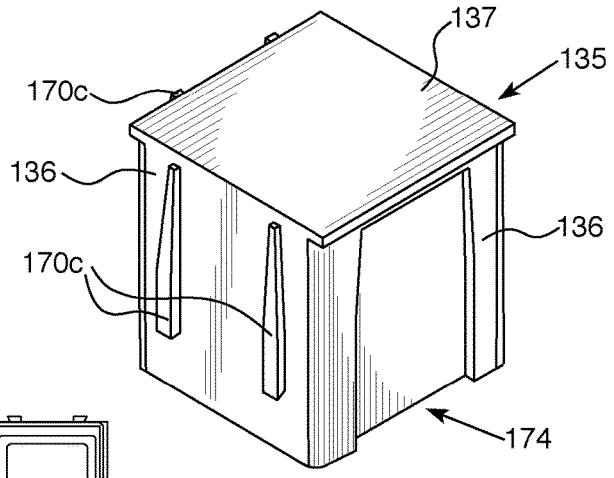
FIG. 18 is a perspective view of a hub for connecting frame components in a frame assembly.
Figure 19:
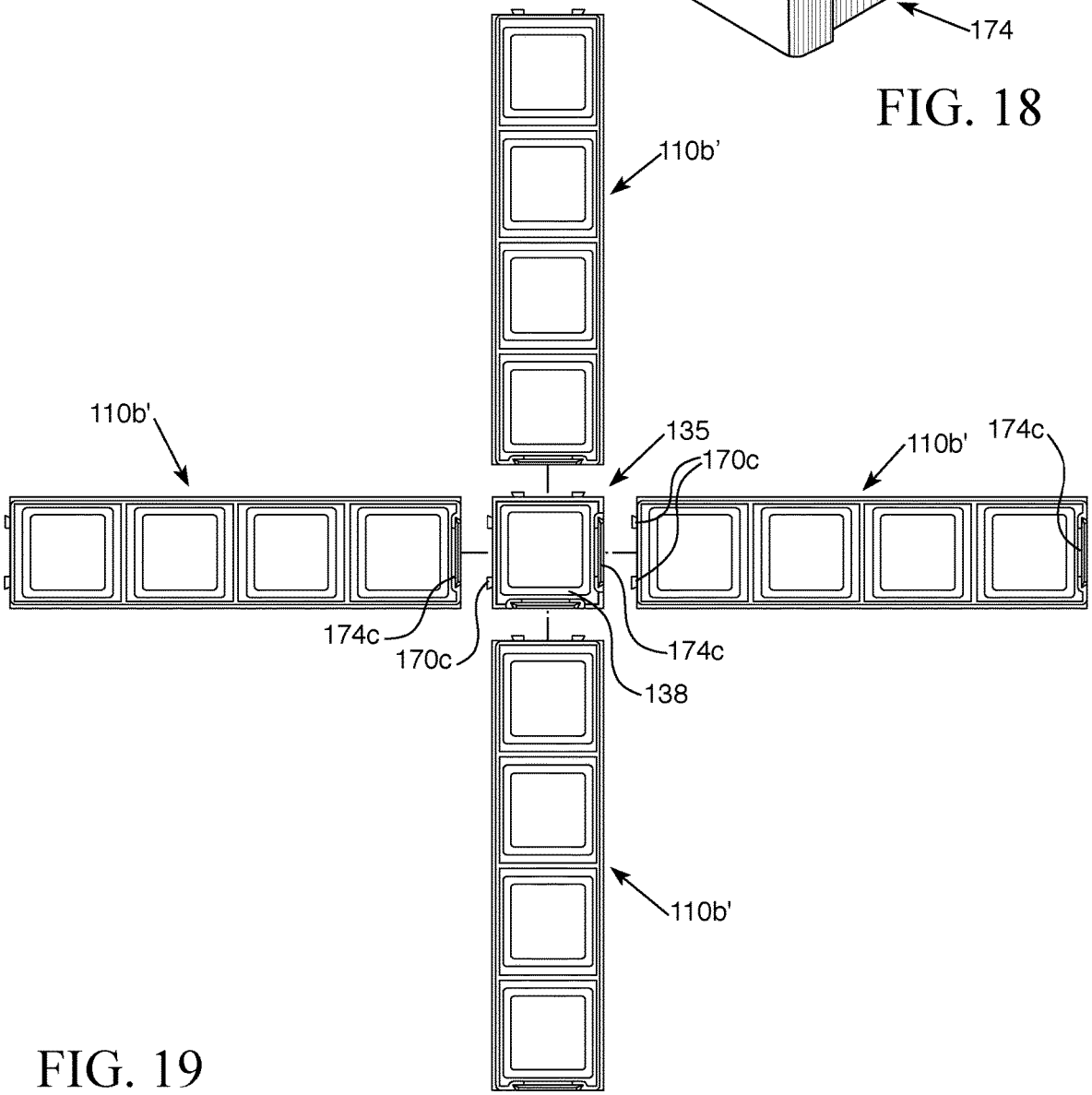
FIG. 19 is an exploded bottom plan view showing one example of a hub connecting to frame components.

A hub 135 may also be used to connect frame components 110', as shown in FIGS. 18 and 19. A hub 135 may be similar to a frame component 110' but has more than two sides 136 each having fasteners 170 or receivers 174, rather than just the two ends 116, 118 of frame components 110'. Hubs 135 may have any number of sides 136, such as but not limited to three, four, five or six. Each hub side 136 may have similar width and height dimensions to the ends 116, 118 of frame components 110', or in certain embodiments may be larger or smaller in certain dimensions of the ends 116, 118 so long as the fasteners 170 or receivers 174 on the hub 135 can align with and connect to respective receivers 174 and fasteners 170 on a frame component 110'. Each side 136 of a hub 135 may include any number of fasteners 170 and receivers 174 in any combination thereof. For instance, as shown in FIGS. 18 and 19, one embodiment of a hub 135 has four sides 136 in which two sides 136 each have two fasteners 170*c* and two sides each have one receiver 174*c*. Such a hub 135 may be used to connect frame components 110*b*'. In other embodiments, the hub 135 may have all fasteners 170 on each side 136, or all receivers 174 on each side 136. Hubs 135 therefore are configured to connect frame components 110' that may not otherwise be able to connect in a particular frame 140 system, such as if two similar ends 116 of different frame components 110' are disposed facing each other that both have fasteners 170 or both have receivers 174 but not the corresponding component. The hub 135 would act as a converter to enable the interconnection of such frame components 110'. Each hub 135 may also include a top 137 and bottom 138 side that may be solid or open. For instance, the hub 135 of FIGS. 18 and 19 has a solid top 135 and an open bottom 138 with a hollow interior, similar to the passages 128 of the frame components 110'. This may allow the hub 135 to be of minimal weight so the frame 140 is not weighed down unnecessarily. In other embodiments, both the top 137 and bottom 138 may be open, such as by having at least one aperture as described previously, to allow for cables, wires and other items to pass therethrough as described below in connection with FIG. 21.

Multiple frame components 110, 110', including any number and combination of the various types discussed above, as may be used to form a frame 140, 140' of the desired size and/or configuration. As mentioned previously, the frame 140 may be assembled at the manufacturer or may be assembled in the field by an end user, such as when using frame components 110' that secure to one another with fasteners 170 and receivers 174 as described above. The frame components 110, 110' in the frame 140, 140' are arranged with their outer surfaces 120 facing away from one another and their inner surfaces 122 facing toward each other, such that the outer apertures 130 are the most exteriorly facing portions of the frame components 110, as shown in FIGS. 1-6 and 21. These outer apertures 130 may provide access into the interior of the wall panel 100 once assembled.

As mentioned previously, the wall panel 100 may also include at least one insert 155 configured to be inserted into an outer aperture 130 of a frame component 110, 110'. In at least one embodiment, the insert 155 may be a cap 160 as shown in FIGS. 20-22 and 28-29 that is configured to cover and/or conceal the outer aperture 130 when inserted therein. The cap 160 includes at least one lug portion 162 that is configured to be received and retrained within a passage 128 of a frame component 110, 110'. Accordingly, the lug portion 162 may be similarly sized and shaped to an outer aperture 130 so as to pass therethrough and a corresponding passage 128 so as to fit within the passage 128. For instance, the lug portion 162 may measure in the range of 0.1-2.0 inches squared and may be about 1 inch squared in at least one embodiment. In certain embodiments, support ribs 124 extending into the passage 128 may contact the lug portion 162 of the cap 160 when inserted therein, providing increased engagement with the lug portion 162 such as frictional engagement for a tighter or more restrained fit. In other embodiments in which the frame component 110' lacks support ribs 124, the frame component 110' itself has increased structural rigidity when secured to adjacent frame components 110' which provides a frictional fit between the lug 126 and outer aperture 130 and/or passage 128 when inserted therein. It should be appreciated that the lug portion 162, as with the outer aperture 130, need not be square but can be rectangular, circular, ovoid, triangular or other shape as will conform or correspond to the outer aperture 130 through which it is inserted. In addition, the lug portion 162 may have a smooth surface or may have ridges, grooves or other elements for increasing the grip or engagement between the lug portion 162 and the passage 128 or outer aperture 130. The lug portion 162 may be the same length, longer or shorter than the passage 128 in which it is retained. For example, in at least one embodiment, the lug portion 162 may have a height in the range of 0.01-1.0 inches and may be about 0.6 inches in at least one embodiment. The lug portion 162 may be solid or hollow throughout, providing more or less rigidity or flexibility as may be required. The lug portion 162 may include some slight angling, such as less than 10, to allow for drafting or a frictional fit with outer aperture 130 and/or passage 128, though this is not necessary.

The cap 160 also includes a cover 166 dimensioned to be at least as, though preferably larger than, the size of an outer aperture 130. Accordingly, the lug portion 162 may be inserted through the outer aperture 130 and into the corresponding passage 128 until the cover 166 stops against the outer surface 120 surrounding the outer aperture 130. As explained above, the cover 166 may be correspondingly dimensioned to a countersunk portion 132 around the outer aperture 130 which receives and retains the cover 166 to cover or conceal the outer aperture 130 in a substantially planar manner. Indeed, the cover 166 may be flush with the outer surface 120 surrounding the outer aperture 130 when the cover 166 is fully within the countersunk portion 132 and the cap 160 is fully seated. Accordingly, the cover 166 may extend past the outer aperture 130 by a predetermined distance which may correspond with the countersunk portion 132, such as by a distance in the range of 0.05-0.5 inches and may be about 0.22 inches in at least one embodiment. When desired, the cap 160 may be removed from the passage 128 and outer aperture 130.

Figure 22:
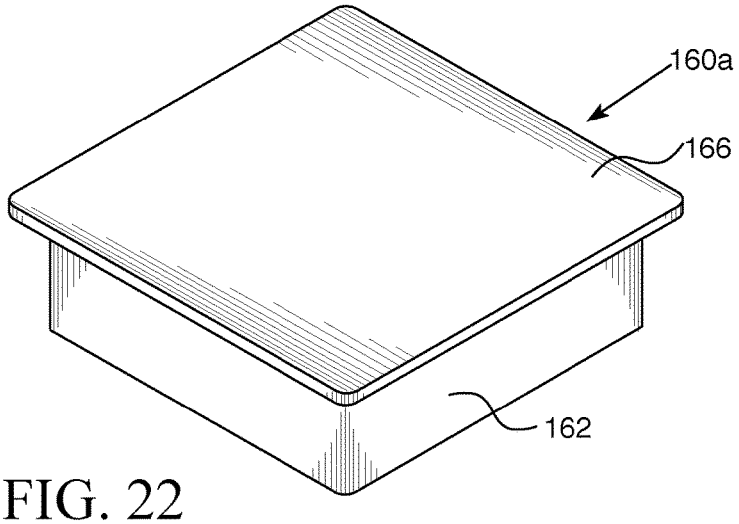
FIG. 22 is a perspective view of one embodiment of a cap as may be used with the modular wall panels and/or system.
Figure 23:
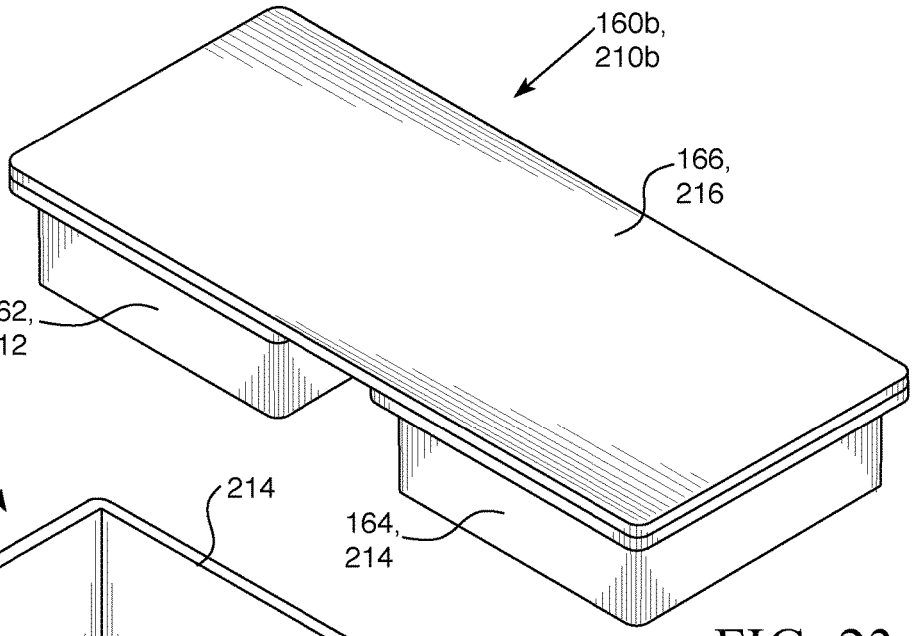
FIG. 23 is a perspective view of a second embodiment of a cap and is also an embodiment of a planar connector.
Figure 28:
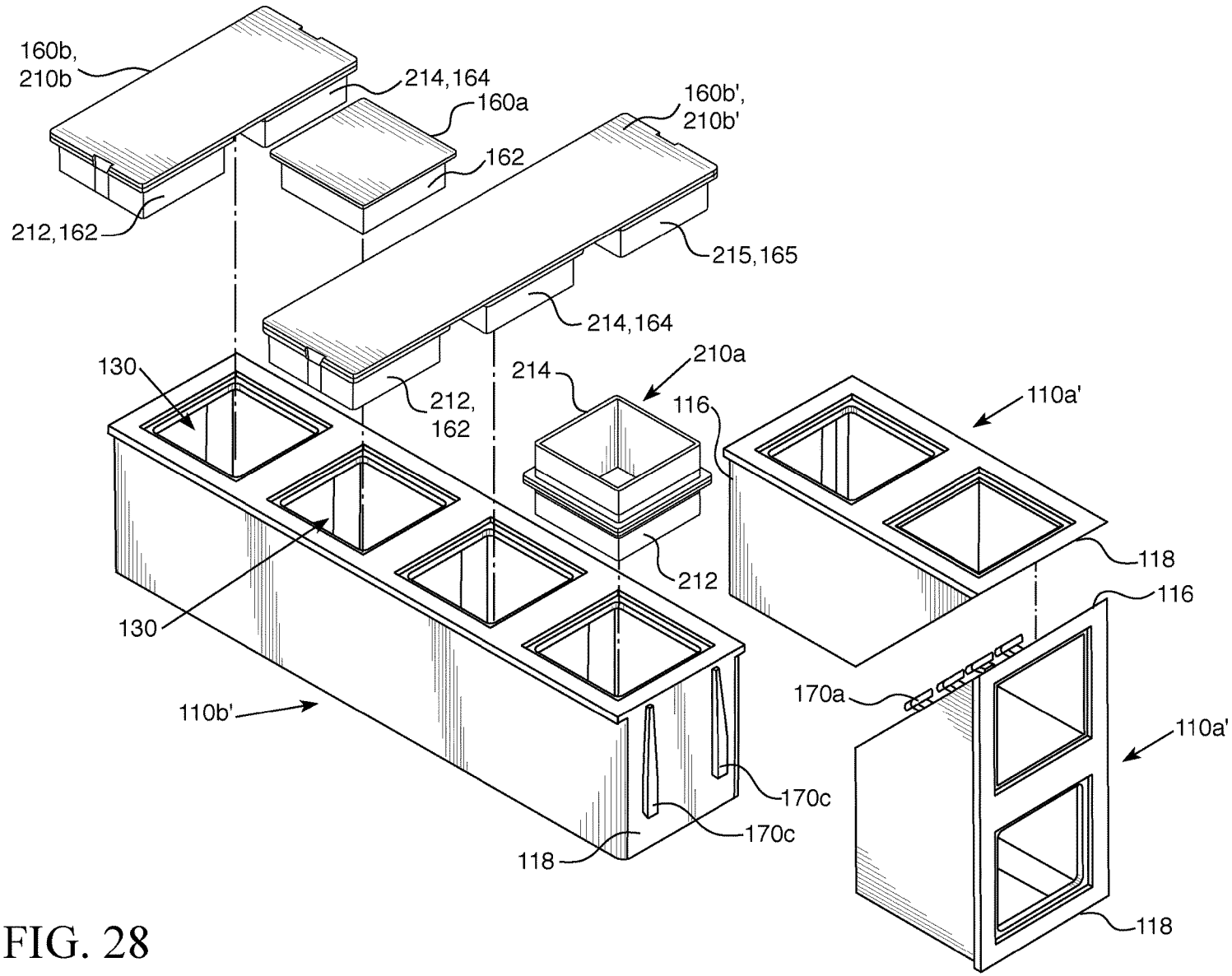
FIG. 28 is a perspective exploded view of another embodiment of a modular wall system of the present invention showing various inserts in alignment for connection.
Figure 29:
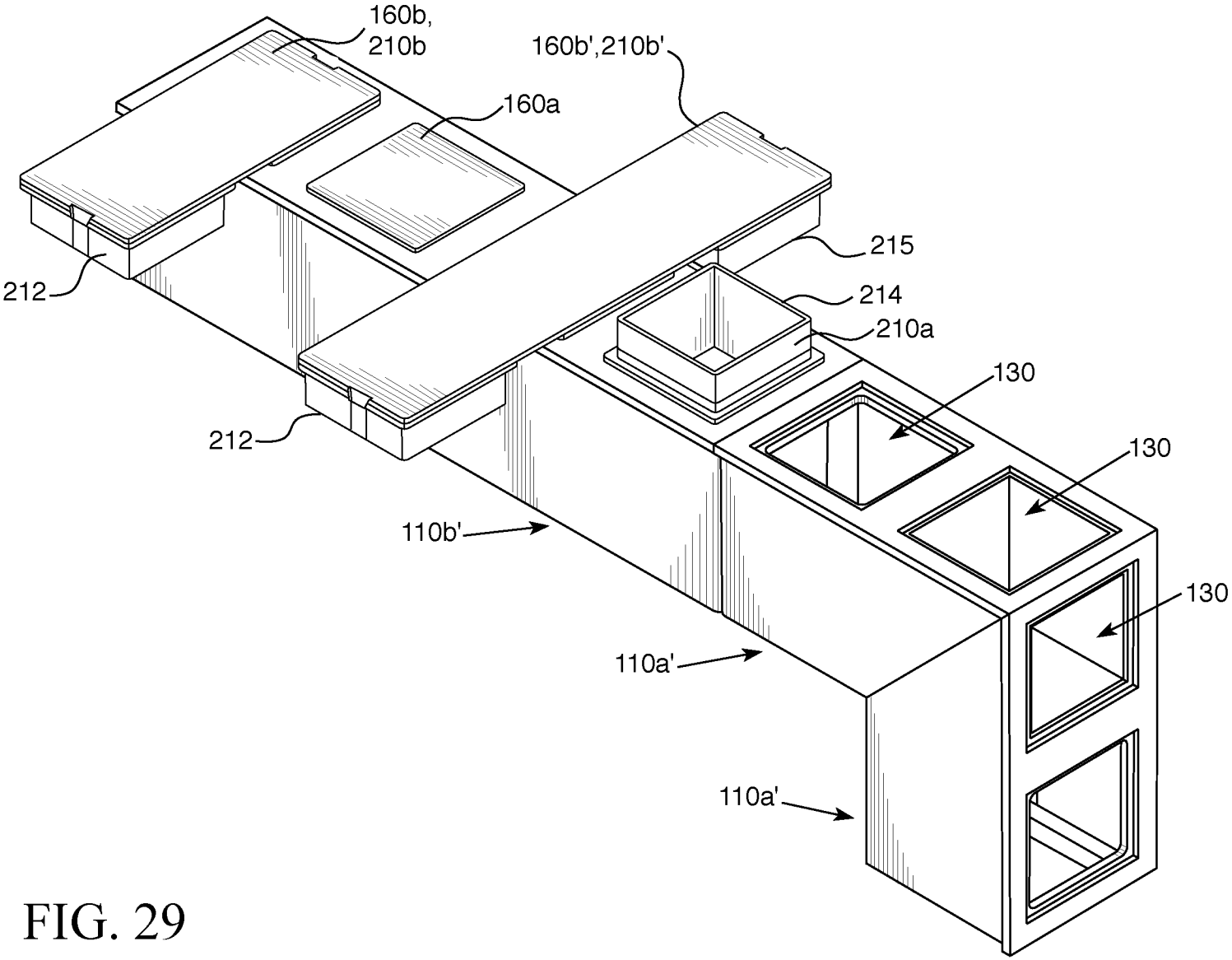
FIG. 29 is a perspective view of the frame components and inserts of FIG. 28 shown connected.

The cap 160 may come in many varieties. For example, it may be a single cap 160*a* as shown in FIGS. 22 and 28, which includes a single lug portion 162 extending from the cover 166, and which is intended to fill in and conceal a single outer aperture 130. However, in some embodiments a single cap 160*a* may have a single lug portion 162 but an extended cover 166 to cover more than one outer aperture 130 despite only one outer aperture 130 being filled. The cap 160 may also be a double cap 160*b*, as shown in FIGS. 23 and 28, which includes a plurality of lug portions, such as a first lug portion 162 and a second lug portion 164 spaced apart from one another and both extending from the same side of the cover 166. Accordingly, the cover 166 may have a longer dimension in a double cap 160*b* than a single cap 160*a*. In a double cap 160*b*, each lug portion 162, 164 is dimensioned to be received and retained within different and adjacent ones of outer apertures 130. Accordingly, more than one outer aperture 130 may be covered or concealed with a double cap 160*b*. The distance between the first and second lug portions 162, 164 is therefore the same distance that separates adjacent outer apertures 130. In further embodiments, the cap 160 may be a triple, quadruple, etc., adding an additional lug portion for each additional outer aperture 130 to be concealed. For instance, FIGS. 28 and 29 show a triple cap 160*c* having a first lug portion 162, second lug portion 164 and third lug portion 165 spaced apart from one another so as to be insertable into different outer apertures 130, which may be on the same or different frame component 110, 110'. The corresponding cover 166 for a triple cap 160*c* is also longer in size and configuration than that of the double cap 160*b* or single cap 160*a*. It should be appreciated that with a double cap 160*b* or more, or with a single cap 160*a* having an extended cover 166, the cover 166 may exceed the boundaries of a countersunk portion 132 at an outer aperture 130. Accordingly, the cover 166 may not sit flush or co-planar with the outer surface 120 of the frame component 110 when a larger cap 160*b* spanning multiple outer apertures 130 is used.

The caps 160 may be used to conceal the outer apertures 130 and any combination of single and multiple caps 160 may be used on a wall panel 100. However, it is not necessary to fill and/or conceal all the outer apertures 130. In at least one embodiment, at least some of the outer apertures 130 may remain open for access to cables or the interior of the wall panel 100. The caps 160 also provide further support to the frame components 110, 110', and therefore the frame 140, 140', when they are inserted into the outer apertures 130. Accordingly, the caps 160 may help prevent the wall panel 100 from tipping over or falling. In particular, a double cap 160*b*, triple cap 160*c* or other multiple cap may be useful along the bottom of a wall panel 100 to help it stand up since they do not countersink into the frame components 110. They may also be used at the top side of the wall panel 100 where they are not as likely to be visible.

Figure 27:
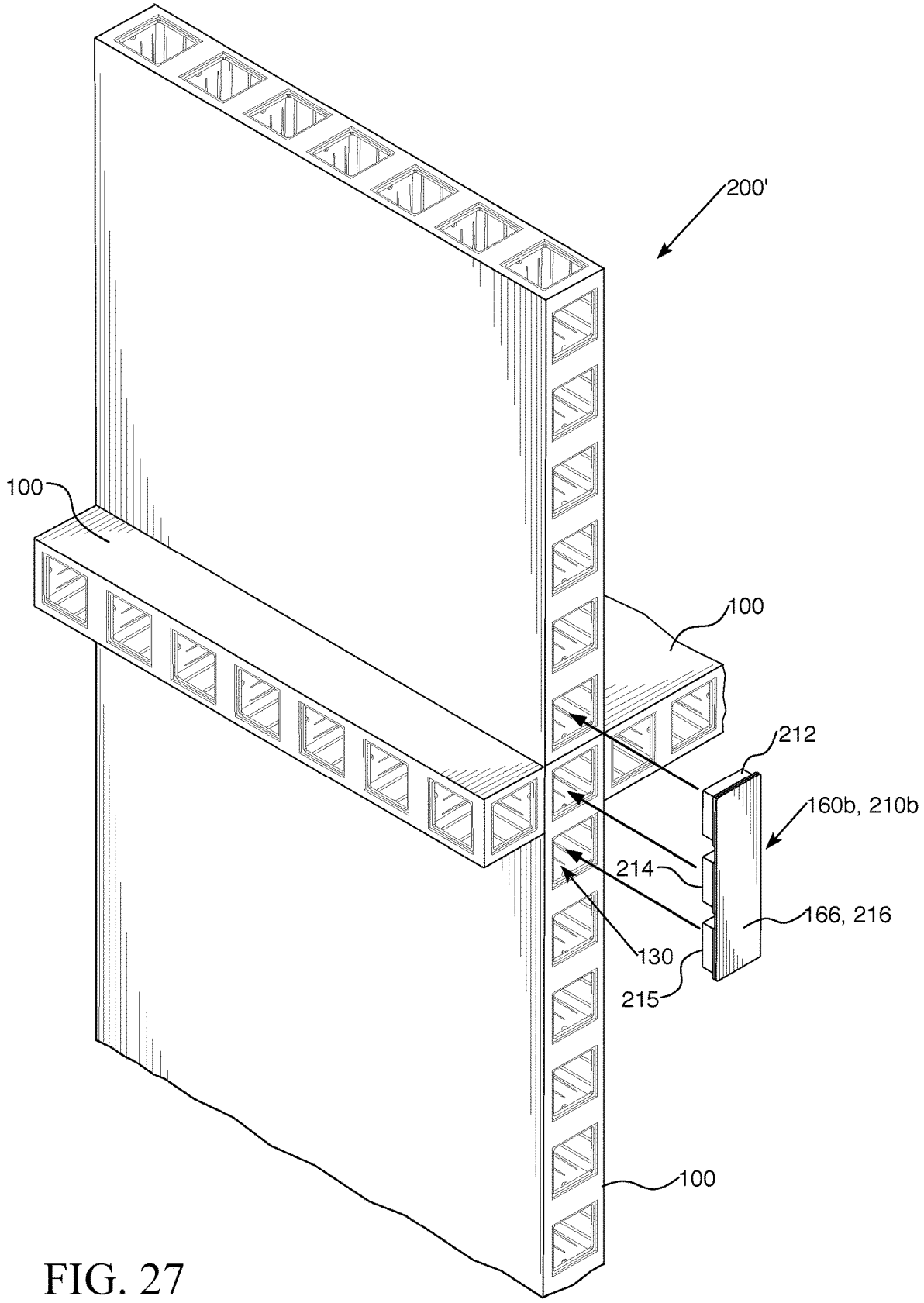
FIG. 27 is a perspective, partially exploded view of another embodiment of a modular wall system of the present invention showing intersecting walls.

The present invention is also directed to a wall system 200 that includes a plurality of wall panels 100 as described above connected to one another with one or more connectors 210. The wall system 200 may be assembled in the field by connecting wall panels 100 together laterally and/or vertically to cover any space or height desired. With reference to FIGS. 20, 21 and 27, the wall system 200 may include any number, combination and configuration of wall panels 100 as discussed above. The wall panels 100 may be connected to adjacent wall panels 100 at their respective outer surfaces 120 of the frames 140. Specifically, the wall system 200 includes at least one connector 210 configured to selectively connect adjacent wall panels 100 through the frame components 110. The connector 210 is another type of insert 155 configured to be received by an outer aperture 130 of a frame component 110. Each connector 210 includes a first lug portion 212 configured to be received and retained in an outer aperture 130 and/or passage 128 of one wall panel 100 and a second lug portion 214 configured to be received and retained in an outer aperture 130 and/or passage 128 of an adjacent wall panel 100. Each lug portion 212, 214 of a connector 210 is similar to the lug portions 162, 164 of the caps 160 discussed above. Any number of connectors 210 may be used to connect adjacent wall panels 100 to one another, and they may interact with at least some of the frame components 110, 110' and at least some of the outer apertures 130 thereof.

There are multiple types of connectors 210. For example, the connector may be a bi-directional connector 210*a* as shown in FIGS. 21, 26, 28 and 29. The bi-directional connector 210*a* has a flange 218 along at least a portion thereof. In at least one embodiment, the flange 218 extends substantially around the circumference or perimeter of the bi-directional connector 210*a*. First and second lug portions 212, 214 extend from opposite sides of the flange 218. Each of the first and second lug portions 212, 214 are dimensioned to fit and be selectively retained within a different outer aperture 130 on different wall panels 100. The flange 218 between the lug portions 212, 214 may be at least the dimensions of an outer aperture 130 of a frame component 110. In at least one embodiment, the flange 218 may be dimensioned to correspond with a countersunk portion 132 associated with an outer aperture 130 of a frame component 110, 110'. Accordingly, the flange 218 may be received within a countersunk portion 132 of at least one, if not both, wall panels 100 being joined together with the bi-directional connector 210*a*. Accordingly, the bi-directional connector 210*a* provides a tight fit between adjacent wall panels 100, forming only a very thin seam between adjacent and abutting or contacting wall panels 100. This increases the structural integrity of the wall system 200 as well as the aesthetics.

Another type of connector is a planar connector 210*b*, examples of which are shown in FIGS. 21, 23 and 27-29. The planar connector 210*b* includes a plurality of lug portions, such as first and second lug portions 212, 214 as described above, but which extend from the same side of a cover 216. Indeed, the double cap 160*b* discussed above may also function as a planar connector 210*b*. When acting as a connector, one lug portion 212 of the planar connector 210*b* is received within a frame component 110, 110', such as an outer aperture 130, of one wall panel 100, and the other lug portion 214 of the planar connector 210*b* is received within a frame component 110, 110' or outer aperture 130 of an adjacent wall panel 100. The planar connector 210*b* may have two, three, four, or more lug portions 212 all extending from the same or common side of a cover 216. For instance, a planar connector 210*b'* is depicted in FIGS. 28-29 having three lug portions 212, 214 and 215. Accordingly, the size of the cover 216 will increase with additional lug portions 212 present. In addition, multiple connectors 210 may be inserted into the same frame component 110, 110', as shown in FIGS. 28 and 29, depending on the number of outer apertures 130 in the corresponding frame component 110, 110' and the desired configuration for adjacent walls 100 or other components of the wall system 200.

Figure 24:
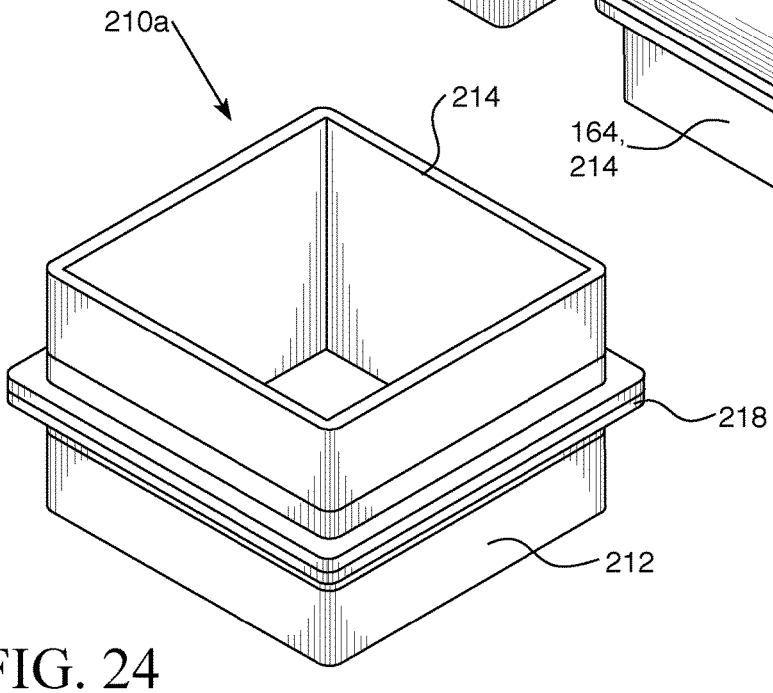
FIG. 24 is a perspective view of a second embodiment of a planar connector, being L-shaped.
Figure 25:
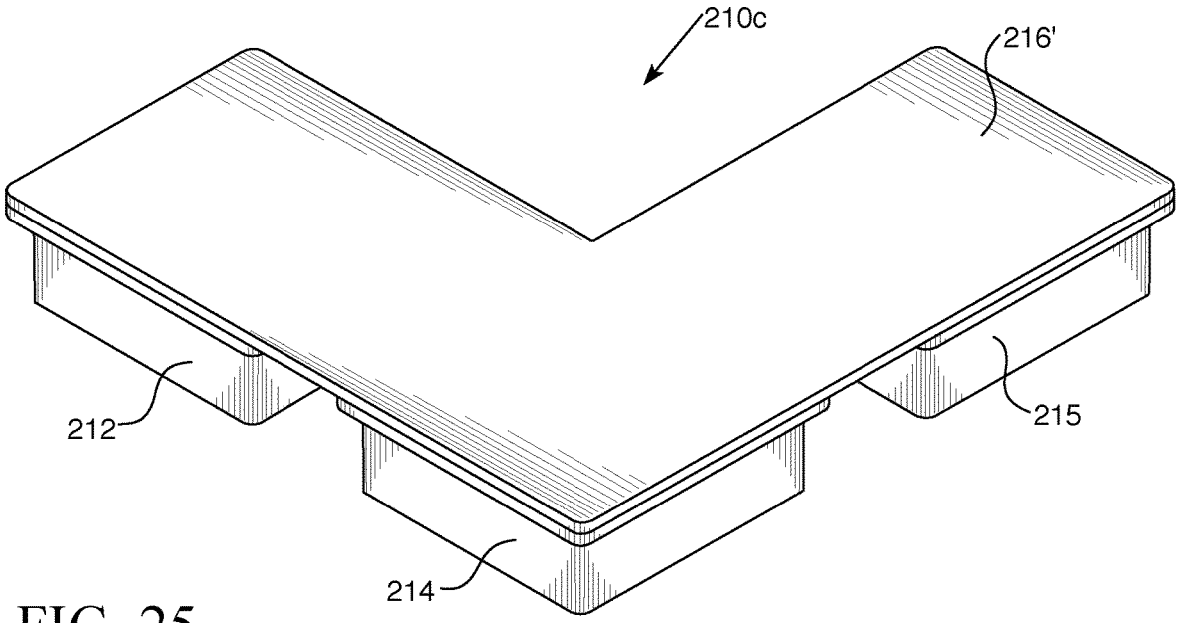
FIG. 25 is a perspective view of a third embodiment of a planar connector, being T-shaped.
Figure 26:
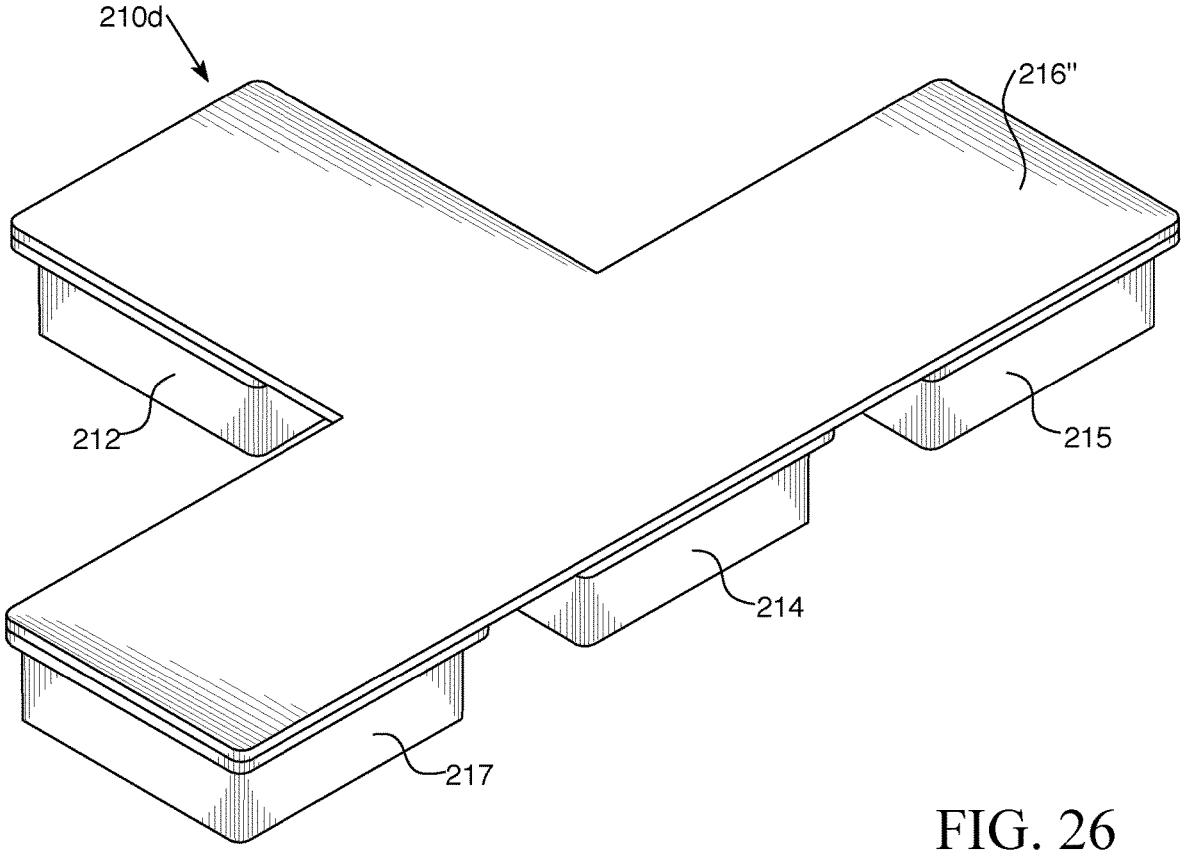
FIG. 26 is a perspective view of an embodiment of a bi-directional connector.

The planar connector 210*b* may come in various configurations. For example, the planar connector 210*b* may be linear in shape, with the length of the connector 210*b* dictated by the number of lug portions 212 it contains. In other examples, the planar connector may have an intersecting configuration to accommodate intersecting or transversely connecting wall panels 100, such as an L-shaped connector 210*c* shown in FIG. 24 and a T-shaped connector 210*d* shown in FIG. 25. The L-shaped connector 210*c* may have at least three lug portions 212, 214, 215 extending from a common side of a cover 216', each spaced apart from one another and configured to fit within a different outer aperture 130, at least two of which are on different frame components 110 of different wall panels 100. Similarly, the T-shaped connector 210*d* may have at least four lug portions 212, 214,

215, 217 each extending from a common side of a cover 216", each spaced apart from one another and configured to fit within a different outer aperture 130, at least two of which are on different frame components 110 of different wall panels 100. Any leg of the L-shaped connector 210*c* or T-shaped connector 210*d* may be longer with additional lug portions.

To assemble the wall system 200, two wall panels 100 are joined together along their outer surfaces 120 of the frame components 110, 110' of their frames 140, such as shown in FIGS. 21 and 27. These adjacent panels may be joined to one another by inserting and sandwiching a bi-directional connector 210*a* therebetween. Specifically, a first lug portion 212 of the connector 210*a* is inserted into an outer aperture 130 of a frame component 110, 110' of one wall panel 100 and the opposite second lug portion 214 is inserted into an outer aperture 130 of a frame component 110, 110' of another wall panel 100 brought adjacent to the first. The flange 218 of the bi-directional connector 210*a* is disposed between the joining frame component 110, 110' of the frames 140, and in at least one embodiment may sit at least partially in the countersunk portions 132 of adjacent outer apertures 130 being joined.

Adjacent wall panels 100 may also be connected by bridging a planar connector 210*b*, 210*b'*, L-shaped connector 210*c* or T-shaped connector 210*d* across the panels 100 exterior to the outer surfaces 120 of the frames 140. To accomplish this, a first lug portion 212 is inserted into an outer aperture 130 of a frame component 110, 110' of one wall panel and a second lug portion 214 is inserted into an outer aperture 130 of an adjacent frame component 110, 110' of a second wall panel 100, such as shown in FIG. 21. In some embodiments, the wall system 200' may include intersecting panels 100, as in FIG. 27, or transversely connecting panels 100 where one or more wall panels 100 terminates at another transverse wall panel 100 such as in a T-shaped configuration. In either of these embodiments, the wall panels 100 may be at an angle relative to one another, such as but not limited to 90°, and may be connected with an L-shaped connector 210*c*, T-shaped connector 210*d*, or linear planar connector 210*b*, 210*b'* having two or three lug portions by inserting a centrally-located lug portion into the outer aperture 130 at the intersection of the wall panels 100 and the remaining lug portions into their corresponding adjacent outer apertures 130 of the wall panels 100, such as shown in FIG. 27. The connectors 210*b*, 210*b'*, 201*c*, 210*d* may be inserted into outer apertures 130 located along the top surfaces of the wall panels 100 to hide them from view and/or along the bottom surfaces of the wall panels 100 to provide additional support to the wall system 200' and keep the wall system 200' from tipping over.

Figure 31:
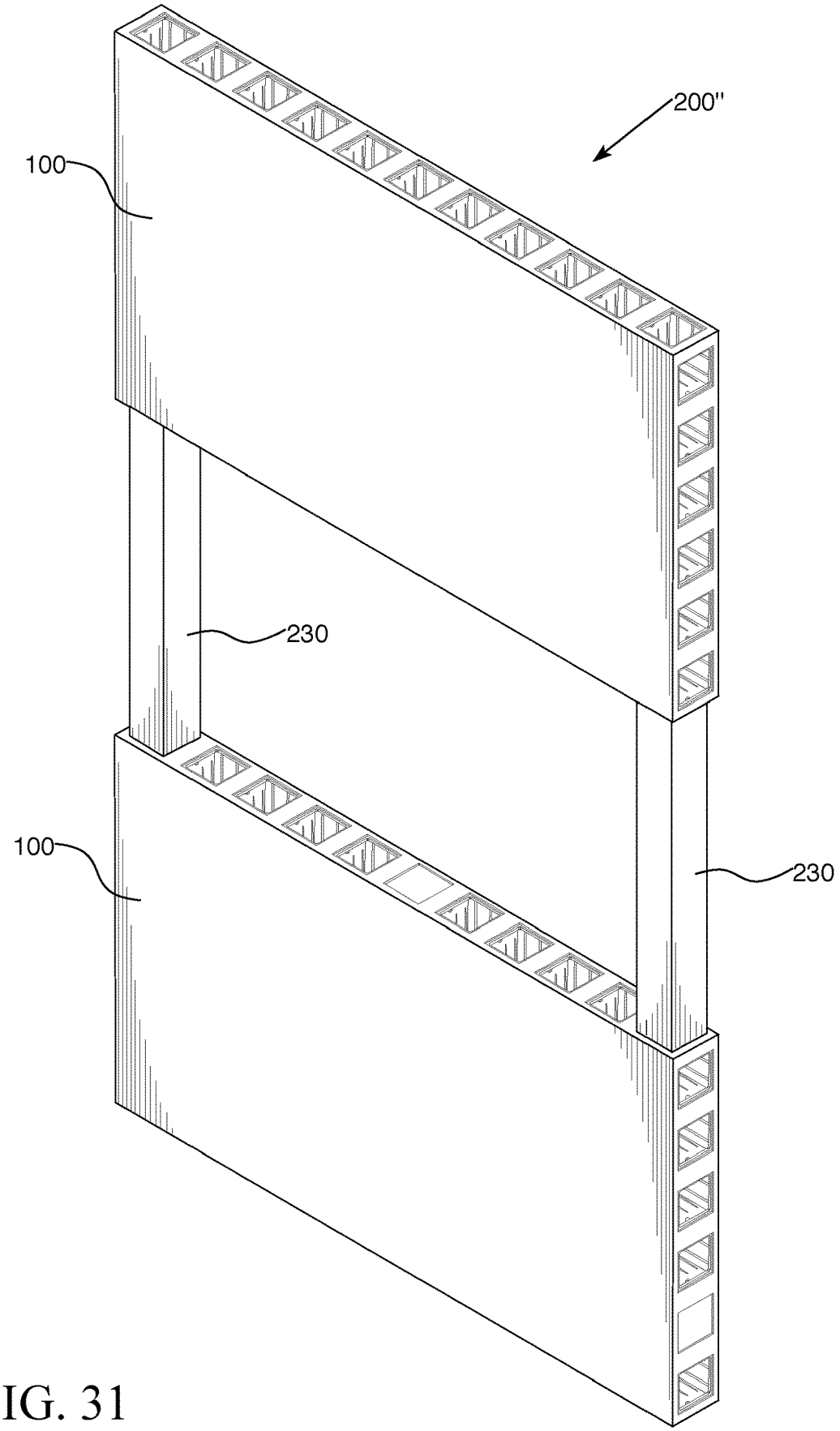
FIG. 31 is a perspective view of another embodiment of a wall system showing spaced apart wall panels.

In still other embodiments, the insert 155 may include a spacer 230, such as shown in FIG. 31, which may be used to assemble a spaced apart configuration of wall system 200". The spacer 230 may be similar to a lug portion 162, 212 of a cap 160 or connector 210 as described above but differs in length. The spacer 230 may therefore also be configured to be received and retained within an outer aperture 130 and/or passage 128 of a frame component 110, 110' but has a longer length than the lug portion 162, 212 of a cap 160 or connector 210. In at least one embodiment, the spacer 230 may be longer than the length of the passage 128. The spacer 230 is configured to connect different wall panels 100 and hold them in a spaced apart relation to one another, rather than contacting or abutting one another. In some embodiments, the spacer 230 may be a rod, bar or other similarly elongate member such as shown in FIG. 31. Such embodiments may be particularly useful in creating larger spaces between wall panels 100 within a system 200". In other embodiments, however, the spacer 230 may be a connector 210*b*, 210*b'*, 210*c*, 210*d* having at least some lug portions 212, 214, etc. spaced further apart than the spacing of outer apertures 130 in adjoining frame components 110 such that proximate wall panels 100 may be connected despite a small space maintained between them. The same may be accomplished by a bi-directional connector 210*a* having longer lug portions 212, 214 on either side of the flange 218 than the corresponding passage 128 such that the entire length of the lug portions 212, 214 do not transverse the passage 128. In such above manners, wall systems 200, 200', 200" may be built to any size, shape, configuration as desired and is therefore entirely customizable.

Cables 220 may be run through the frame components 110 between adjacent wall panels 100, such as through the outer apertures 130, inner apertures 132 and passages 128 as shown in FIG. 21. The cables 220 may therefore also run through the bi-directional connectors 210*a* that join adjacent wall panels 100. Of course, cables 220 may also be run between frame components 110, 110', such as when frame components 110, 110' are not contiguous the cables 220 may be run in the space between. When all the cables 220 are run, any empty outer apertures 130 may be filled with a cap 160, if desired, though not every outer aperture 130 needs to be capped.

The wall system 200, 200', 200" may also be easily disassembled when desired, such as at the end of event, to remodel office space, or to update the configuration or options of the system 200, 200', 200". To disassemble, the steps are simply reversed, with the wall panels 100 being able to be pulled away from the lug portions 212, 214 of the connectors 210, the caps 160 and spacers 230 removed, and the cables 220 pulled back through. The components of the wall system 200 may be easily transported to another site for reassembly.

Since many modifications, variations and changes in detail can be made to the described preferred embodiments, it is intended that all matters in the foregoing description and shown in the accompanying drawings be interpreted as illustrative and not in a limiting sense. Thus, the scope of the invention should be determined by the appended claims and their legal equivalents. Now that the invention has been described,

What is claimed is:

1. A frame component for forming a perimetric frame of a modular wall panel having an interior space at least partially defined by said perimetric frame, said frame component comprising:

a first end and an opposite second end;

face walls spaced apart from one another and extending between said first and second ends;

an outer surface extending transversely between and substantially perpendicular to corresponding edges of said face walls, said outer surface forming an exterior boundary of said perimetric frame and disposed at a perimeter of said modular wall panel when assembled, said outer surface having at least one outer aperture extending therethrough;

an inner surface opposite said outer surface, said inner surface forming an interior boundary of said perimetric frame and at least partially defining an interior space of said modular wall panel between said inner surface of different ones of said frame components collectively forming said perimetric frame when assembled, said inner surface having at least one inner aperture extending therethrough;

a passage formed between said at least one outer aperture and said at least one inner aperture, said passage configured to provide ingress and egress to said interior space of said modular wall panel (i) through said exterior boundary of said perimetric frame at said perimeter of said modular wall panel and (ii) between respective interior spaces of adjacent joined modular wall panels, said passage further configured to receive and selectively restrain a portion of an insert therein; and end walls each:

(i) interposed between said face walls at a different one of said first and second ends;

(ii) being one of substantially perpendicular to said outer and inner surfaces and at an oblique angle relative to said outer and inner surfaces; and (iii) having at least one of (a) at least one fastener and (b) at least one receiver dimensioned to receive and removably retain a corresponding one of said at least one fastener, such that each of said end walls of one frame component is configured to selectively attach to a corresponding end wall of an adjacent frame component in forming said wall frame.

2. The frame component of claim 1, wherein said at least one fastener includes (i) a stem having a length extending along or away from said first or second end wall, and (ii) an engagement portion located on said stem and configured to pass through and selectively engage said corresponding at least one receiver.

3. The frame component of claim 2, wherein said engagement portion is located at a free terminal end of said stem.

4. The frame component of claim 2, wherein at least a portion of said stem is made of resilient material permitting temporary flexing of said stem between a resting position and at least one deflected position resulting from application of force to said stem, wherein said engagement portion is configured to move into and out of said corresponding at least one receiver with the movement of said stem between said resting position and said at least one deflected position.

5. The frame component of claim 2, where said stem is rigid and said engagement portion is movable into and out of said corresponding receiver by alignment and movement of said frame component relative to an adjacent frame component.

6. The frame component of claim 2, wherein said receiver includes a first portion configured to permit passage of said engagement portion of said corresponding at least one fastener, and a second portion in communication with said first portion and configured to permit passage of said stem and restrict passage of said engagement portion therethrough.

7. The frame component of claim 2, wherein both said engagement portion and said stem extend from said first or second end wall.

8. The frame component of claim 7, wherein said engagement portion is co-extensive with said stem.

9. The frame component of claim 8, wherein said receiver includes at least one wall defining an opening such that said receiver is recess formed in said first or second end wall and said engagement portion of said corresponding at least one fastener are inserted into said opening.

10. The frame component of claim 1, wherein said oblique angle is an acute angle.

11. A modular wall panel, comprising:

a plurality of frame components each as recited in claim 1 and selectively attached to an adjacent one of said frame components at respective ones of said end walls to collectively form said perimetric frame having at least one face perpendicular to said outer surface of frame components forming said perimetric frame; and at least one wall sheet affixed to said at least one face of said perimetric frame, said interior space defined collectively between said at least one wall sheet and said inner surfaces of said frame components forming said perimetric frame.

12. The modular wall panel of claim 11, wherein said insert is a cap having: (i) a lug portion dimensioned to be received in one of said at least one outer aperture and (ii) a cover having a larger dimension than said at least one outer aperture, said cap configured to substantially block said outer aperture when said lug portion is received in said outer aperture.

13. The modular wall panel of claim 12, further comprising a countersunk portion associated with said at least one outer aperture and correspondingly dimensioned to receive said cover of said cap.

14. The modular wall panel of claim 12, wherein said cap further comprising a plurality of lug portions each extending from said cover and spaced apart from one another, each of said plurality of lug portions configured to be received and selectively retained within different ones of said at least one outer aperture.

15. The wall panel of claim 11, wherein said outer surface overhangs said face of said frame by an amount substantially similar to a thickness of said at least one wall sheet.

16. The wall panel of claim 11, wherein said frame supports at least one of (i) an edge, (ii) a corner, and (iii) an interior surface of said at least one wall sheet.

17. The wall panel of claim 16, wherein said frame includes a sub-assembly configured to support a feature in said at least one wall sheet, said feature being at least one of a (i) window, (ii) door and (iii) screen, said feature including at least one of (a) indicia, (b) lighting, (c) design, (d) color, and (e) transparent material.

18. A modular wall system, comprising:

a plurality of modular wall panels each as recited in claim 11; and at least one connector having:

(i) a first lug portion configured to be received and selectively retained within one of said at least one outer aperture in one of said frame components of a first modular wall panel; and (ii) a second lug portion configured to be received and selectively retained within one of said at least one outer aperture in one of said frame components of a second modular wall panel.

19. The modular wall system of claim 18, wherein said at least one connector is one of: (i) a bi-directional connector having a flange, said first and second lug portions extending from opposite sides of said flange; (ii) a planar connector including a cover having a larger dimension than said at least one outer aperture, said at least first and second lug portions extending from a common side of said cover and spaced apart from one another; and (iii) a spacer configured to hold said first and second modular wall panels in spaced apart relation relative to one another.

20. The modular wall system of claim 19, wherein said planar connector is one of: (i) a linear connector, (ii) a T-shaped connector, and (iii) an L-shaped connector.

21. The modular wall system of claim 19, wherein at least one of said plurality of frame components further includes a countersunk portion at least partially surrounding said at least one outer aperture and correspondingly dimensioned to receive said flange of said bi-directional connector.

22. The modular wall system of claim 19, wherein said bi-directional connector is dimensioned to permit passage of a cable through said first and second lug portions and between connected ones of said modular wall panels.

23. A hub for connecting frame components, said hub comprising:

at least three sides each having at least one of (a) at least one fastener and (b) at least one receiver dimensioned to receive and removably retain a corresponding one of said at least one fastener; and a top disposed perpendicular to and connecting said sides;

wherein each of said sides is configured to selectively attach to an end wall of a different frame component as recited in claim 1.

24. The hub of claim 23, wherein said at least one fastener includes (i) a stem having a length extending along or away from said side, and (ii) an engagement portion located on said stem and configured to pass through and selectively engage said corresponding at least one receiver.

25. The hub of claim 24, wherein at least a portion of said stem is made of resilient material permitting temporary flexing of said stem between a resting position and at least one deflected position resulting from application of force to said stem, wherein said engagement portion is configured to move into and out of said corresponding at least one receiver with the movement of said stem between said resting position and said at least one deflected position.

26. The hub of claim 24, where said stem is rigid and said engagement portion is movable into and out of said corresponding receiver by alignment and movement of said frame component relative to an adjacent frame component.

27. The hub of claim 24, wherein said receiver includes a first portion configured to permit passage of said engagement portion of said corresponding at least one fastener, and a second portion in communication with said first portion and configured to permit passage of said stem and restrict passage of said engagement portion therethrough.

28. The hub of claim 24, wherein both said engagement portion and said stem extend from said side.

29. The hub of claim 28, wherein said engagement portion is co-extensive with said stem.

30. The hub of claim 29, wherein said receiver includes at least one wall defining an opening such that said receiver is recess formed in said side and said engagement portion of said corresponding at least one fastener are inserted into said opening.

31. The hub of claim 24, wherein said hub includes two sides each having at least one fastener and two sides each have at least one receiver.

32. The hub of claim 31, wherein said sides having at least one fastener are adjacent one another and said sides having at least one receiver are adjacent one another.

33. The hub of claim 23, wherein all sides have either at least one fastener or at least one receiver.

34. The hub of claim 23, wherein said top includes at least one aperture extending therethrough.

* * * * *